US007976287B2

(12) United States Patent
Hwang et al.

(10) Patent No.: US 7,976,287 B2
(45) Date of Patent: Jul. 12, 2011

(54) CAPACITY VARIABLE TYPE TWIN ROTARY COMPRESSOR AND DRIVING METHOD THEREOF

(75) Inventors: Seon-Woong Hwang, Gyeonggi-Do (KR); Seong-Jae Hong, Gyeongsangnam-Do (KR); Kyoung-Jun Park, Busan (KR); Jin-Kook Kim, Gyeongsangnam-Do (KR); Ji-Young Bae, Busan (KR)

(73) Assignee: LG Electronics Inc., Seoul (KR)

( * ) Notice: Subject to any disclaimer, the term of this patent is extended or adjusted under 35 U.S.C. 154(b) by 1168 days.

(21) Appl. No.: 11/659,719

(22) PCT Filed: Aug. 9, 2005

(86) PCT No.: PCT/KR2005/002580
§ 371 (c)(1),
(2), (4) Date: Feb. 8, 2007

(87) PCT Pub. No.: WO2006/016763
PCT Pub. Date: Feb. 16, 2006

(65) Prior Publication Data

US 2008/0031756 A1 Feb. 7, 2008

(30) Foreign Application Priority Data

Aug. 12, 2004 (KR) ..... 10-2004-0063566

(51) Int. Cl.
*F04B 49/00* (2006.01)

(52) U.S. Cl. ..... 417/213; 417/216; 417/410.3; 418/23; 418/60

(58) Field of Classification Search ..... 417/216, 417/902, 410.3, 213; 418/23, 32, 11, 60; 62/176.3, 469, 115
See application file for complete search history.

(56) References Cited

U.S. PATENT DOCUMENTS 5,131,826 A 7/1992 Boussicault
(Continued)

FOREIGN PATENT DOCUMENTS

JP 01-247786 10/1989
(Continued)

OTHER PUBLICATIONS

Japanese Office Action dated Oct. 1, 2009.

*Primary Examiner* — Charles G Freay
*Assistant Examiner* — Todd D Jacobs
(74) *Attorney, Agent, or Firm* — KED & Associates LLP

(57) ABSTRACT

A capacity variable type twin rotary compressor may include a casing, a motor, a first cylinder having a first compression space, a second cylinder fixed to one side of the first cylinder and having a second compression space, first and second intakes respectively formed in the first and second cylinders and each connected to a gas intake pipe, first and second vane slits respectively formed in the first and second intakes first and second rolling pistons eccentrically coupled to the motor and respectively housed in the first and second compression spaces, first and second vanes slidingly received in the first and second vane slits, respectively, an expansion groove formed at the second vane slit separate from the inner space of the casing, and refrigerant switching valves that allow refrigerant of intake and discharge pressures to be supplied into the second compression space and the expansion groove, such that the second vane contacts the second rolling piston to perform a power driving or separates therefrom to perform a saving driving.

5 Claims, 12 Drawing Sheets

U.S. PATENT DOCUMENTS

| | | | | |
|---|---|---|---|---|
| 5,170,636 | A * | 12/1992 | Hitosugi | 62/175 |
| 6,716,007 | B2 * | 4/2004 | Kim et al. | 418/23 |
| 7,290,994 | B2 * | 11/2007 | Kitaichi et al. | 418/60 |
| 2004/0009083 | A1 | 1/2004 | Kim et al. | |
| 2007/0154329 | A1 * | 7/2007 | Onoda | 417/216 |
| 2008/0193310 | A1 * | 8/2008 | Byun et al. | 418/23 |

FOREIGN PATENT DOCUMENTS

| | | | |
|---|---|---|---|
| JP | 01247786 | A * | 10/1989 |
| WO | WO2005/061901 | | 7/2005 |
| WO | WO 2005611901 | | 7/2005 |

* cited by examiner

CAPACITY VARIABLE TYPE TWIN ROTARY COMPRESSOR AND DRIVING METHOD THEREOF

TECHNICAL FIELD

The present invention relates to a capacity variable type twin compressor, and particularly, to a capacity variable type twin compressor capable of preventing a vane jumping phenomenon which can occur when varying capacity and capable of various capacity varying driving and a driving method thereof, and an air conditioner having the same and a driving method thereof.

BACKGROUND ART

In general, a compressor converts a mechanical energy into a compression energy of a compressible fluid, and can be generally divided into a reciprocal type, a scroll type, a centrifugal type and a vane type.

A rotary compressor is typically applied to an air conditioner. As functions of the air conditioner are diversified these days, a rotary compressor capable of varying capacity has been demanded. For this, a method by which compressor capacity is varied by controlling the rotation numbers of the compressor is known. However, this method requires for a complicated controller to thereby increase the product price. A capacity varying unit that is cheap and stable needs to be provided. The present invention relates to this.

FIG. 1 is a twin rotary compressor in accordance with a conventional art, FIG. 2 is a block diagram for varying capacity in a conventional capacity variable type twin rotary compressor, and FIGS. 3 to 6 are plan views a change of a vane according to each driving in the conventional capacity variable type twin rotary compressor.

As shown therein, the conventional twin rotary compressor includes as illustrated in FIG. 1: a casing 1 installing a gas intake pipe (SP) and a gas discharge pipe (DP) such that the gas intake pipe (SP) and the gas discharge pipe (DP) communicate with each other; a motor unit 2 comprising a stator 2*a* and a rotor 2*b* installed at an upper side of the casing 1 so as to generate a rotating force; and a first compression unit 10 and a second compression unit 20 vertically installed at a lower side of the casing 1, receiving a rotating force being generated from the motor unit 2 by a rotating shaft 3 and individually compressing refrigerant.

As illustrated in FIG. 2, one accumulator 4 for separating liquid refrigerant from intake refrigerant is installed between the gas intake pipe (SP) and each of the compression units 10 and 20. A refrigerant switching valve 5, which is a three-way valve, switching the refrigerant and supplying the refrigerant to the second compression unit is installed between an outlet of the accumulator 4 and the gas discharge pipe (DP).

In addition, the nutlet of the accumulator 4 is connected with an intake 11*a* of a first cylinder 11 and an intake-side inlet 5*a* of the refrigerant switching valve 5, a bypass pipe 32 diverges from the gas discharge pipe (DP) and is connected with a discharge-side inlet 5*b* of the refrigerant switching valve 5, and an outlet 5*c* of the intake side of the refrigerant switching valve 5 is connected to an intake side of the second compression unit 20, all of which are described later.

As illustrated in FIGS. 1 and 2, the first compression unit 10 includes: the first cylinder 11 having an annular shape and installed inside the casing 1; a main bearing 12 and a middle bearing 13 covering both upper and lower sides of the first cylinder 11, forming a first inner space (V1) and radially supporting the rotating shaft; a first rolling piston 14 rotatably coupled with an upper eccentric part of the rotating shaft 3 and compressing the refrigerant, orbiting in the first inner space (V1) of the first cylinder 11; a first vane (not illustrated) movably coupled with the first cylinder 11 in a radial direction so as to pressingly contact to an outer circumferential surface of the first rolling piston 14 and dividing the first inner space (V1) of the first cylinder 11 into a first intake chamber and a first compression chamber; and a first discharge valve 15 openably coupled to a front end of a first discharge port 12*a* formed in the vicinity of the center of the main bearing 12 so as to control the discharge of the refrigerant being discharged from the first compression chamber.

The first cylinder 11 forms a first vane slit (not illustrated) reciprocating in the radial direction by inserting the first vane (not illustrated) into one side of an inner circumferential surface forming the first inner space (V1), forms the first intake 11*a* communicating with the outlet of the accumulator 4 and inducing intake refrigerant at one side of the first vane slit, and forms a first discharge groove 11*b* discharging refrigerant gas being discharged from the first compression chamber into the casing I at the other side of the first vane slit.

As illustrated in FIGS. 1 to 3, the second compression unit 20 includes: a second cylinder 21 having an annular shape and installed under the first cylinder 11 inside the casing 1; a middle bearing 13 and a sub-bearing 22 covering both upper and lower sides of the second cylinder 21, forming a second inner space (V2), and supporting the rotating shaft 3 in a radial direction and in an axial direction; a second rolling piston 23 rotatably coupled with a lower eccentric part of the rotating shaft 3 and compressing the refrigerant, orbiting in the second inner space (V2) of the second cylinder 21; a second vane (illustrated in FIG. 3) 24 movably coupled with the second cylinder 21 in the radial direction so as to pressingly contact to an outer circumferential surface of the second rolling piston 23 and dividing the second inner space (V2) of the second cylinder 21 into a second intake chamber and a second compression chamber; and a second discharge valve 25 openably coupled with a front end of a second discharge port 22*a* formed in the vicinity of the center of the sub-bearing 22 and controlling the discharge of the refrigerant gas being discharged from the second chamber.

The second cylinder 21 forms a second vane slit 21*a* at one side of an inner circumferential surface forming the second inner space (V2) such that the second vane 24 reciprocates in the radial direction, forms a second intake 21*b* at one side of the second vane slit 21*a* such that intake refrigerant or discharge refrigerant flows in by connecting a second refrigerant guide pipe 33 with the outlet 5*c* of the intake side of the refrigerant switching valve 5, and forms a second discharge groove 21*c* discharging refrigerant being discharged from the second compression chamber into the casing 1 at the other side of the second vane slit 21*a*.

An expansion groove communicating with the inside of the casing 1 is formed at a rear end of the second vane slit 21*a* such that the rear side of the second vane 24 is affected by internal pressure of the casing 1, and a permanent magnet 26 is installed at expansion groove 21*d* so as to attract the second vane 24. Undescribed numeral reference 31 denotes a first refrigerant guide pipe.

The driving of the conventional twin rotary compressor will be described.

That is, when power is supplied to the stator 2*a* of the motor unit 2 to thereby rotate the rotor 2*b*, the rotating shaft 3 rotates together with the rotor 2*b* and transfers a rotary force of the motor unit 2 to the first compression unit 10 and the second compression unit 20. The first compression unit 10 and the second compression unit 20 perform power driving to thereby generate large-capacity cooling capability or only the first compression unit 10 performs power driving and the second compression unit performs saving driving to thereby generate small capacity cooling capability.

Here, each driving with respect to the second compression unit of the twin rotary compressor will be described in detail.

First, in a starting state as illustrated in FIG. 3, by communicating the inlet 5*a* and the outlet 5*c* of the intake side of the refrigerant switching valve 5 with each other, refrigerant gas of balance pressure is drawn into the second inner space (V2) of the second cylinder 21 through the second intake 21*b* . As pressure inside the casing 1 still maintains balance pressure (Pb), pressure (PB) of the refrigerant gas pushing the rear end of the second vane 24 and compression chamber pressure (Pb) of the second inner space (V2) maintains an approximate balance state.

Accordingly, the second vane 24 is attracted by a magnetic force of the permanent magnet 26, moves outside of the second vane slit 21*a*, and is separated from the second rolling piston 23, so that compression does not occur. In this state, the so-called vane jumping phenomenon that internal pressure of the casing 1 increases so that the second vane 24 is separated from the permanent magnet 26, comes in contact with the second rolling piston 23 and is attached to the permanent magnet 26 again repetitively occurs.

Next, as illustrated in FIG. 4, in a power state, as the driving continues in the above-described starting state, pressure inside the casing 1 increases to discharge pressure (Pd), while pressure of the refrigerant gas drawn into the second inner space (V2) decreases to intake pressure (Ps).

Accordingly, as rear-side pressure of the second vane 24 considerably increases in comparison to front-side pressure, the second vane 24 is separated from the permanent magnet 26 and pressingly contacts with the second rolling piston 23 so that compression of the refrigerant gas gets started.

Next, in a saving state as illustrated in FIG. 5, as the refrigerant switching valve 5 drives to communicate the discharge-side inlet 5*b* and the intake-side outlet 5*c* communicate with each other, part of the refrigerant gas of the discharge pressure (Pd) flows in the second inner pace (V2) of the second cylinder 21. Here, as internal pressure of the casing 1 still maintains a discharge pressure (Pd) state, the rear-side pressure and the front-side pressure of the second vane 24 becomes in a balanced state. By a magnetic force, the second vane 24 moves to the rear side where the permanent magnet 26 exists and is separated from the second rolling piston 23. As a result, compression does not occur in the second cylinder 21.

Meanwhile, when a driving state is changed, for example, as illustrated in FIG. 5, when the second compression unit 20 is changed from the saving state to the power state, at the moment when pressure of the refrigerant flowing in the second intake 21*b* is changed into the intake pressure (Ps) from the discharge pressure (Pd), contact between the second vane 24 and the second rolling piston 23 becomes unstable and the vane jumping phenomenon occurs again. That is, the pressure of when the intake-side inlet 5*a* and the intake-side outlet 5*c* in the refrigerant switching valve 5 communicate with each other is less reduced than the discharge pressure (Pd) and becomes middle pressure (Pd+a). On the other hand, as pressure inside the casing 1 still maintains the discharge pressure (Pd), a force by differential pressure is greater than that by a magnetic force of the permanent magnet 26. Thus, the second vane 24 overcomes the magnetic force and comes in contact with the second rolling piston 23 to divide the second inner space (V2) into a compression chamber and an intake chamber, such that compression is performed in the second inner space (V2) of the second cylinder. However, when the compression chamber pressure of the second inner space (V2) reaches the discharge pressure (Pd) again, the force by the differential pressure becomes greater than the magnetic force. As the second vane 25 is retracted by the permanent magnet 26 and is separated from the second rolling piston 23, compression does not occur and the driving state is changed into the power state.

However, in the conventional capacity variable type twin rotary compressor, as the so-called vane jumping phenomenon that the second vane 24 is detached from the second rolling piston 23 by a disproportion between differential pressure and a magnetic force when the compressor starts or its driving is switched occurs, noises of the compressor are increased. In addition, in order to reduce compressor noises in consideration of this during the starting, the starting must be performed when the second vane 24 is completely separated from the second rolling piston 23, that is, only in a saving mode.

In addition, in the conventional capacity variable type twin rotary compressor, as the second compression unit 20 performs variable driving, while the first compression unit 10 always performs normal driving, it is constructed to perform two-step capacity variable driving, which causes a limit to various control of functions of the air conditioner and deteriorates energy efficiency by generating cooling capability more than necessary and increasing unnecessary power consumption.

DISCLOSURE OF THE INVENTION

Therefore, an object of the present invention is to provide a capacity variable type twin rotary compressor capable of reducing noises of a compressor by eliminating a jumping phenomenon of a vane when the compressor is started or its driving is switched and therefore capable of starting the compressor in a power mode as well as a saving mode and a driving method thereof, and an air conditioner having the same and a driving method thereof.

In addition, it is another object of the present invention to provide a capacity variable type twin rotary compressor capable of various functions of an air conditioner by allowing capacity of the compressor to vary according to more than two steps and increasing energy efficiency by reducing power consumption and a driving method thereof, and an air conditioner having the same and a driving method thereof.

To achieve these and other advantages and in accordance with the purpose of the present invention, as embodied and broadly described herein, there is provided a capacity variable type twin rotary compressor comprising: a casing having a particular inner space and connecting a gas discharge pipe such that the gas discharge communicates with the inner space; a first cylinder and a second cylinder fixedly installed at the inner space of the casing so as to be separated from each other, each having an intake directly connecting a gas intake pipe and a discharge port communicating with the gas discharge port at both sides of a circumferential direction on the basis of each vane slit, and forming an expansion groove at an outer diameter side of one of the vane slit to separate the expansion groove from the inner space of the casing; a first vane and a second vane slidingly inserted into the vane slits of the cylinders, respectively, in a radial direction; a first rolling piston and a second rolling piston inserted into eccentric parts, respectively, of a rotating shaft so as to pressingly contact with the respective vanes and compressing refrigerant, orbiting inside the cylinders; a vane-side pressure varying unit directly connected to the expansion groove separated from the inner space of the casing and alternately supplying refrigerant of intake pressure or discharge pressure on occasion demands such that the vane pressingly contacts with the corresponding rolling piston to perform power driving or the vane is separated from the corresponding rolling piston to perform saving driving; a cylinder-side pressure varying unit installed at the middle of the gas intake pipe having the vane-side pressure varying unit and alternately supplying refrigerant of intake pressure or discharge pressure to the corresponding cylinder on occasion demands such that the vane together with the vane-side pressure varying unit pressing contacts with or is separated from the rolling piston; and a vane supporting unit installed at the expansion groove of the cylinder to which the vane-side pressure varying unit is connected and supporting the rear side of the corresponding vane in a direction of the rolling piston.

To achieve these and other advantages and in accordance with the purpose of the present invention, as embodied and broadly described herein, there is provided a capacity variable type twin rotary compressor comprising: a casing having a particular inner space and connecting a gas discharge pipe such that the gas discharge communicates with the inner space; a first cylinder and a second cylinder fixedly installed at the inner space of the casing so as to be separated from each other, each having an intake directly connecting a gas intake pipe and a discharge port communicating with the gas discharge port at both sides of a circumferential direction on the basis of each vane slit, and each forming an expansion groove at an outer diameter side of the vane slit to separate the expansion groove from the inner space of the casing; a first vane and a second vane slidingly inserted into the vane slits of the cylinders, respectively, in a radial direction; a first rolling piston and a second rolling piston inserted into eccentric parts, respectively, of a rotating shaft so as to pressingly contact with the respective vanes and compressing refrigerant, orbiting inside the cylinders; a first vane-side pressure varying unit and a second vane-side pressure varying unit directly connected to the expansion groove separated from the inner space of the casing and alternately supplying refrigerant of intake pressure or discharge pressure on occasion demands such that the vane pressingly contacts with the corresponding rolling piston to perform power driving or the vane is separated from the corresponding rolling piston to perform saving driving; a first cylinder-side pressure varying unit and a second cylinder-side pressure varying unit installed at the expansion grooves of the cylinders, respectively, the vane-side pressure varying units are connected with and supporting the rear surfaces of the corresponding vanes in a direction of the respective rolling pistons.

To achieve these and other advantages and in accordance with the purpose of the present invention, as embodied and broadly described herein, there is provided a method for driving a capacity variable type twin rotary compressor, comprising: during the starting driving of the cylinder having the expansion groove separated from the inner space of the casing while the capacity variable type twin rotary compressor is being driven, the corresponding cylinder-side pressure varying unit and the vane-side pressure varying unit are controlled such that the corresponding vane is always in contact with an outer circumferential surface of the rolling piston by the vane supporting unit and compresses the refrigerant by supplying refrigerant of the same pressure to the intake and the expansion groove of the cylinder.

To achieve these and other advantages and in accordance with the purpose of the present invention, as embodied and broadly described herein, there is provided a method for driving a capacity variable type twin rotary compressor, comprising: during the power driving of the cylinder having the expansion groove separated from the inner space of the casing while the capacity variable type twin rotary compressor is being driven, the corresponding cylinder-side pressure varying unit and the vane-side pressure varying unit are controlled such that the corresponding vane is always in contact with an outer circumferential surface of the rolling piston by differential pressure between internal pressure of the cylinder and pressure inside the expansion groove and a repulsive force of the corresponding vane supporting unit and compresses the refrigerant by supplying refrigerant of intake pressure to the intake of the cylinder and refrigerant of discharge pressure to the expansion groove of the cylinder.

To achieve these and other advantages and in accordance with the purpose of the present invention, as embodied and broadly described herein, there is provided a method for driving a capacity variable type twin rotary compressor, comprising: during the saving driving of the cylinder having the expansion groove separated from the inner space of the casing while the capacity variable type twin rotary compressor is being driven, the corresponding cylinder-side pressure varying unit and the vane-side pressure varying unit are controlled such that the corresponding vane overcomes pressure inside the expansion groove and a repulsive force of the vane supporting unit by internal pressure of the cylinder, is pushed toward the rear side and separated from an outer circumferential surface of the rolling piston, and the refrigerant is leaked to an intake chamber from a compression chamber by supplying refrigerant of discharge pressure to the intake of the cylinder and refrigerant of intake pressure to the expansion groove of the cylinder.

To achieve these and other advantages and in accordance with the purpose of the present invention, as embodied and broadly described herein, there is provided a method for driving a capacity variable type twin rotary compressor, comprising: when the saving driving is switched into the power driving in the cylinder having the expansion groove separated from the inner space of the casing while the capacity variable type twin rotary compressor is being driven, the corresponding cylinder-side pressure varying unit and the vane-side pressure varying unit are controlled such that the corresponding vane is always in contact with an outer circumferential surface of the rolling piston by differential pressure between second middle pressure and first middle pressure and a repulsive force of the corresponding vane supporting unit and compresses refrigerant by supplying refrigerant of the first middle pressure which is gradually decreased less than discharge pressure to the inner space of the cylinder and refrigerant of the second middle pressure which is gradually increasing greater than intake pressure.

To achieve these and other advantages and in accordance with the purpose of the present invention, as embodied and broadly described herein, there is provided an air conditioner having the capacity variable type twin rotary compressor.

To achieve these and other advantages and in accordance with the purpose of the present invention, as embodied and broadly described herein, there is provided a method for driving an air conditioner having a capacity variable type twin rotary compressor, comprising: detecting room temperature and switching a driving mode of a compressor into a power driving mode when the room temperature reaches [desired temperature+A° C.]; switching the driving mode of the converter into a saving driving mode when the room temperature reaches the desired temperature; and switching the driving mode of the converter into the power driving mode again when the room temperature increases again and exists in [desired temperature+A° C.] for two minutes consecutively and otherwise stopping the compressor if the room temperature decreases and reaches [desired temperature−B° C.].

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODES FOR CARRYING OUT THE PREFERRED EMBODIMENTS

Reference will now be made in detail to a capacity variable type twin rotary compressor and a driving method thereof on one embodiment of the present invention, examples of which are illustrated in the accompanying drawings.

Figure 7:
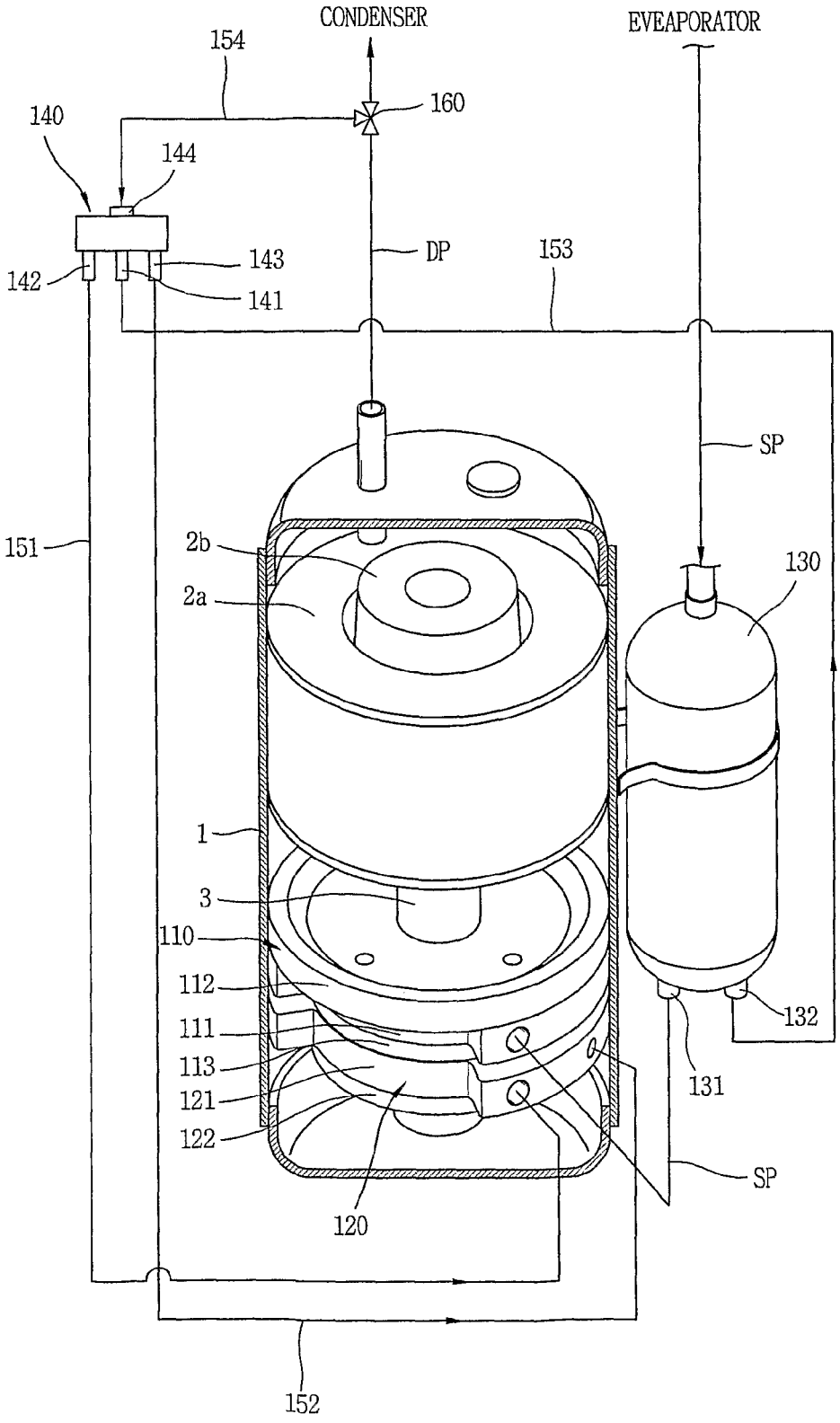
FIG. 7 is a block diagram for varying capacity in one example of a capacity variable type twin rotary compressor of the present invention.

FIG. 7 is a longitudinal sectional view showing one example of a capacity variable type twin rotary compressor of the present invention, and FIGS. 8 to 11 are plane views showing a change of a vane according to each driving state in the capacity variable type twin rotary compressor of the present invention.

As illustrated therein, a capacity variable type twin rotary compressor of the present invention includes: a casing 1 installing a gas intake pipe (SP) and a gas discharge pipe (DP) such that the gas intake pipe (SP) and the gas discharge pipe (DP) communicate with each other; a motor unit 2 installed at an upper side of the casing 1 and generating a rotating force; and a first compression unit 110 and a second compression unit 120 vertically installed at a lower side of the casing 1, receiving a rotating force being generated from the motor unit 2 by a rotating shaft 3 and individually compressing refrigerant:

In addition, one accumulator 130 for separating liquid refrigerant from intake refrigerant is installed between the gas intake pipe (SP) and each of the compression units 110 and 120. A refrigerant switching valve 140, which is a four-way valve, switching the refrigerant and supplying the refrigerant to the second compression unit 120 is installed between an outlet of the accumulator 130 and the gas discharge pipe (DP).

In addition, a first outlet 131 of the accumulator 130 is connected with a first intake 111*b* of a first cylinder 111 to be described later and a second outlet 132 of the accumulator 130 is connected with an intake-side inlet 141 of a refrigerant switching valve 140 to be described later via a third refrigerant guide pipe 153.

Figure 1:
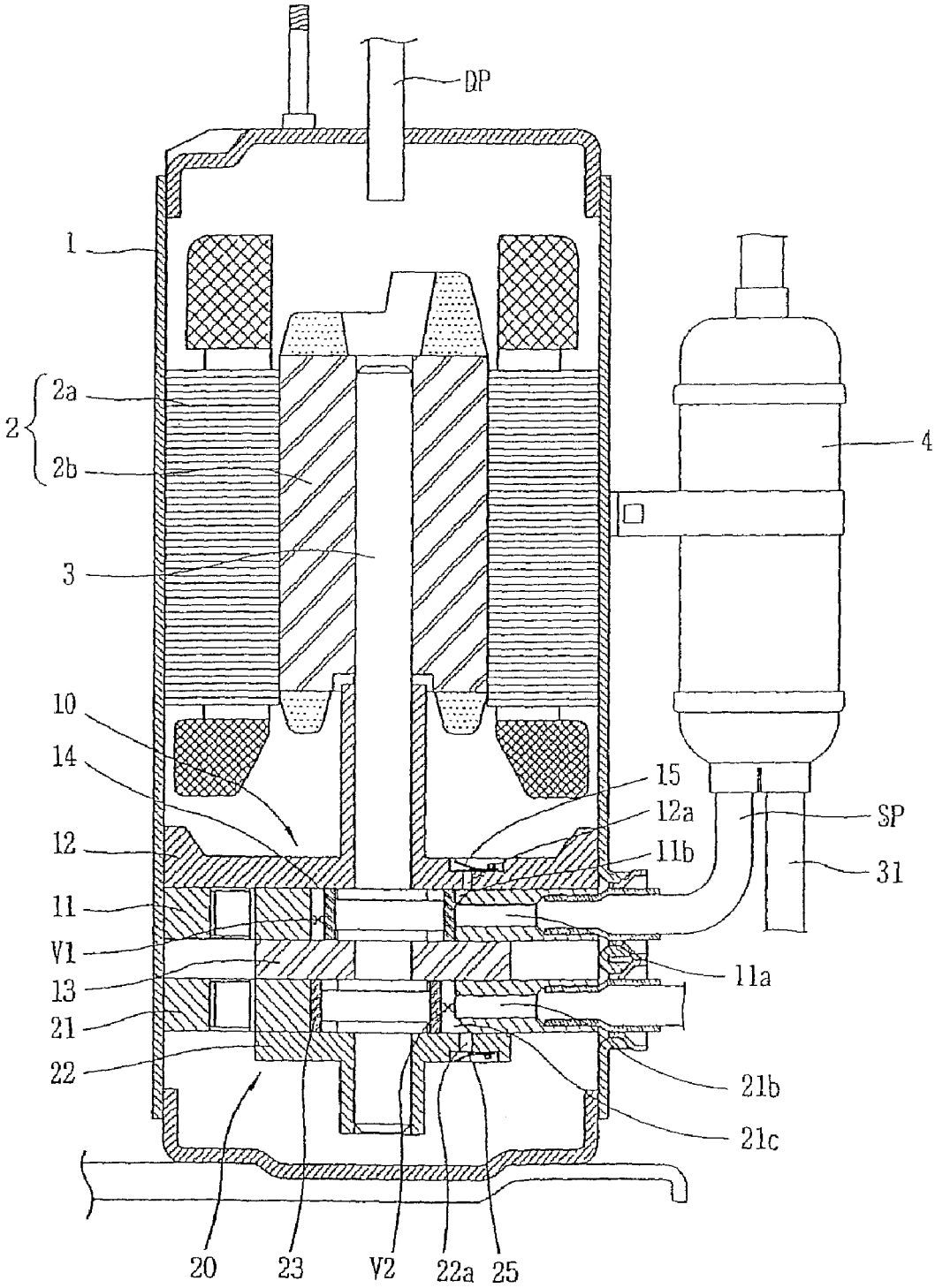
FIG. 1 CONVENTIONAL ART
FIG. 1 is a longitudinal sectional view showing an example of a conventional capacity variable type twin rotary compressor.
Figure 2:
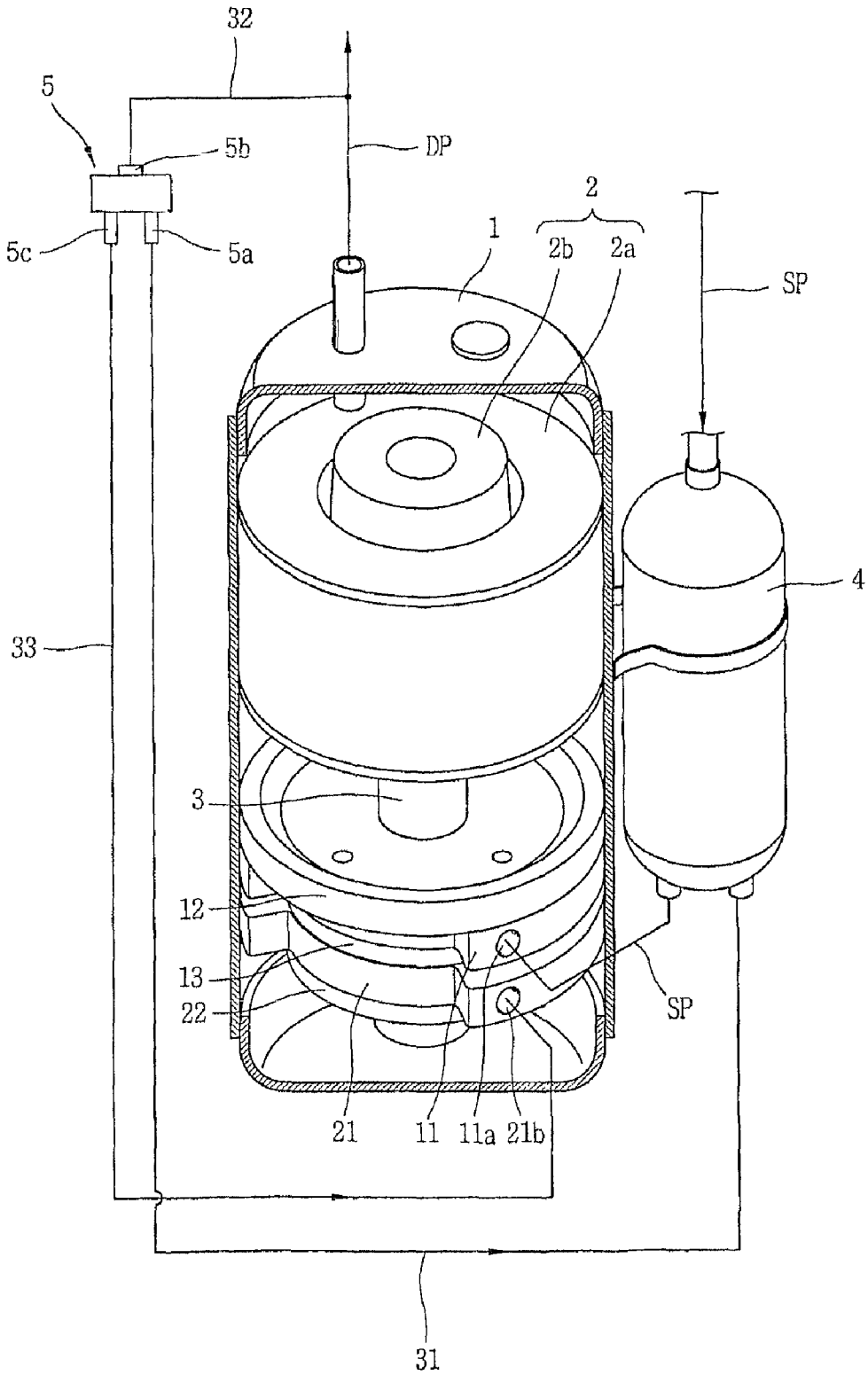
FIG. 2 CONVENTIONAL ART
FIG. 2 is a block diagram for varying capacity in the conventional capacity variable type twin rotary compressor.

The first compression unit 110 includes: the first cylinder 111 having an annular shape and installed inside the casing 1; a main bearing 112 and a middle bearing 113 covering both upper and lower sides of the first cylinder 111, forming a first inner space (V1) and radially supporting the rotating shaft 3; a first rolling piston 114 rotatably coupled with an upper eccentric part of the rotating shaft 3 and compressing the refrigerant, orbiting in the first inner space (V1) of the first cylinder 111; a first vane (not illustrated) 115 movably coupled with the first cylinder 111 in a radial direction so as to pressingly contact to an outer circumferential surface of the first rolling piston 114 and dividing the first inner space (V1) of the first cylinder 111 into a first intake chamber and a first compression chamber; a first vane spring 116 which is a compression spring so as to elastically support the rear side of the first vane 115; and a first discharge valve 15 (illustrated in FIG. 1) openably coupled to a front end of a first discharge port 12*a* (illustrated in FIG. 1) formed in the vicinity of the center of the main bearing 112 so as to control the discharge of the refrigerant being discharged from the compression chamber of the first inner space (V1).

The first cylinder 111 forms a first vane slit 111*a* (not illustrated) at one side of an inner surface forming the first inner space (V1) such that the first vane 115 reciprocates in the radial direction, forms the first intake 111*b* at one side in a circumferential direction on the basis of the first bane slit 111*a* so as to induce the refrigerant into the first inner space (V1), and forms a first discharge groove 111*c* at the other side of the circumferential direction on the basis of the first vane slit 111*a* in an axial direction so as to discharge the refrigerant into the casing 1.

The first vane slit 111*a* slidingly inserts and installs the first vane 115 thereinto in the radial direction, and by forming a first expansion groove 111*d* at the rear end, installs the first vane spring 116 formed of a compression spring so as to elastically support the first vane 115 at the rear side, that is, at the first expansion groove 111*d*.

The first intake 111*b* is radially formed so as to penetrate the first cylinder 111 from its outer circumferential surface to its inner circumferential surface, and its inlet end directly communicates with the first outlet 131 of the accumulator 130. In addition, the first intake 111*b* and the first discharge groove 111*c* can be formed on the same axis as respect to a second discharge groove 121*c* to be described later. However, in order to precisely control the compressor, it is preferable that they are formed on the same axis.

Meanwhile, though not illustrated in the drawing, the first vane 115 can be supported by permanent magnets with the same polarity facing each other except for the first vane spring.

Figure 3:
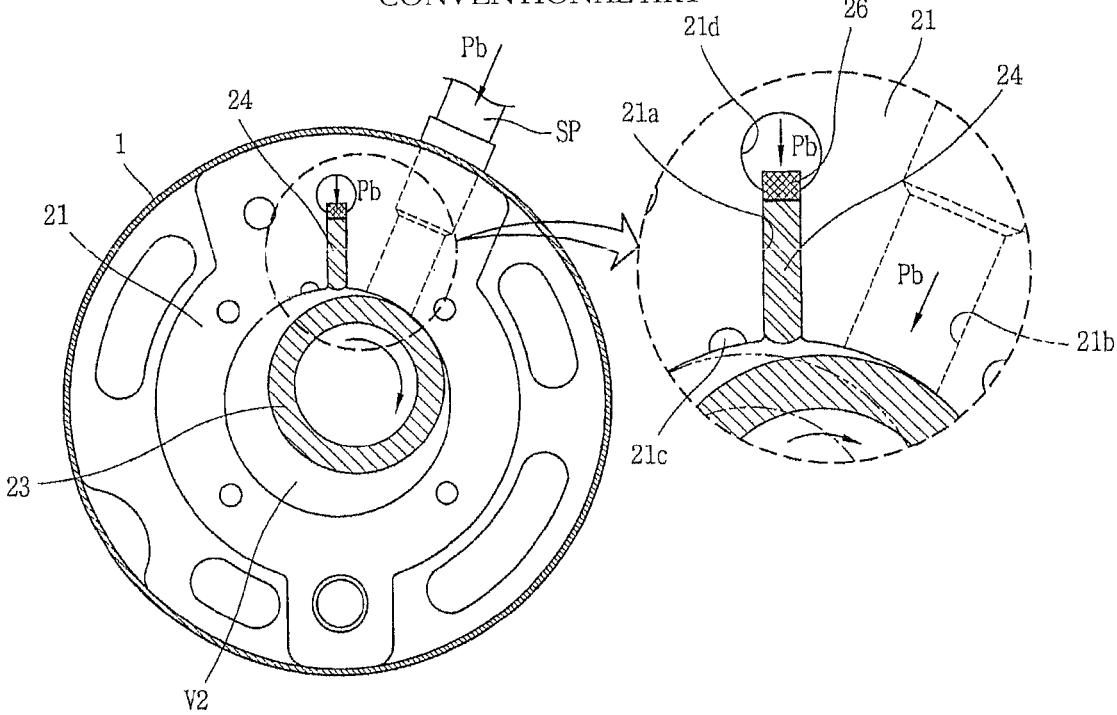
FIG. 3 CONVENTIONAL ART
FIGS. 3 to 6 are plane views showing a change of a vane according to each driving state in the conventional capacity variable type twin rotary compressor.
Figure 4:
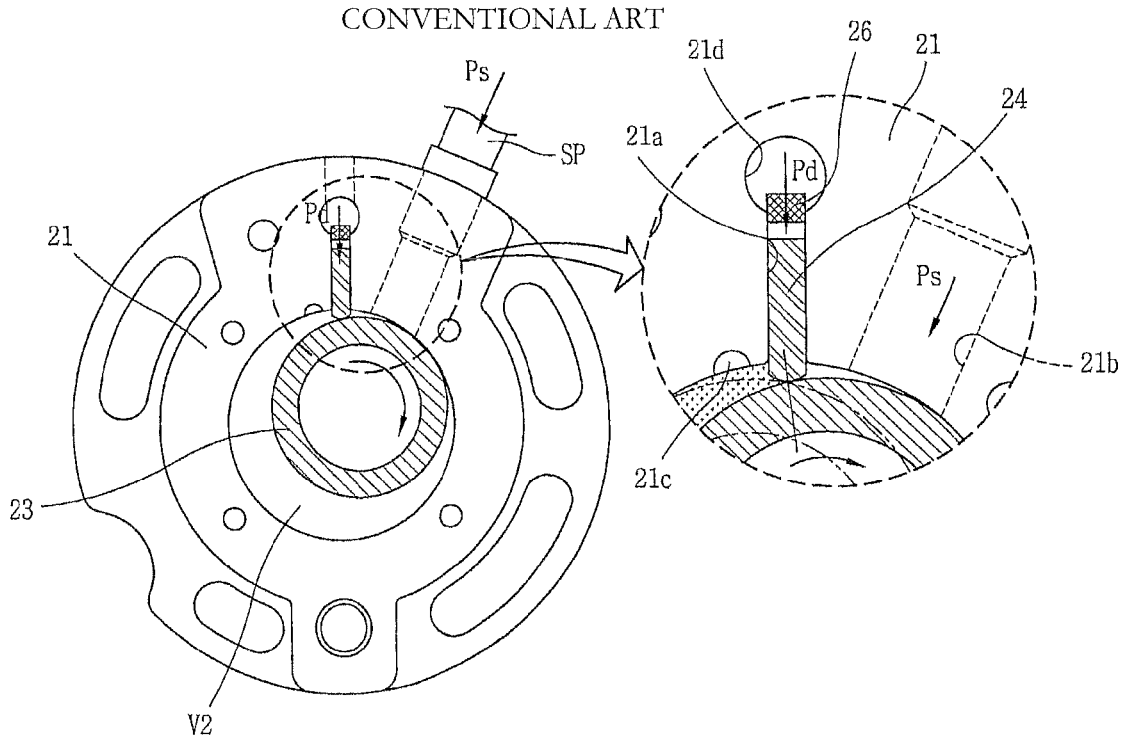
FIG. 4 CONVENTIONAL ART
Figure 5:
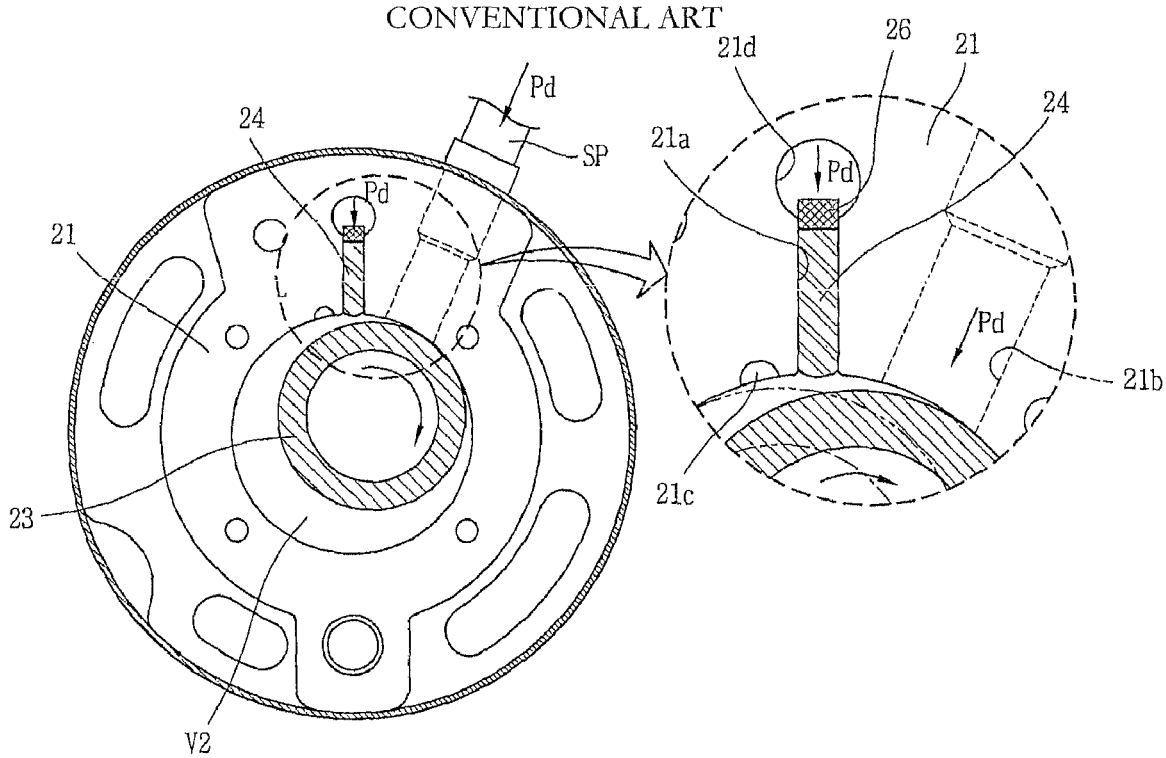
FIG. 5 CONVENTIONAL ART
Figure 6:
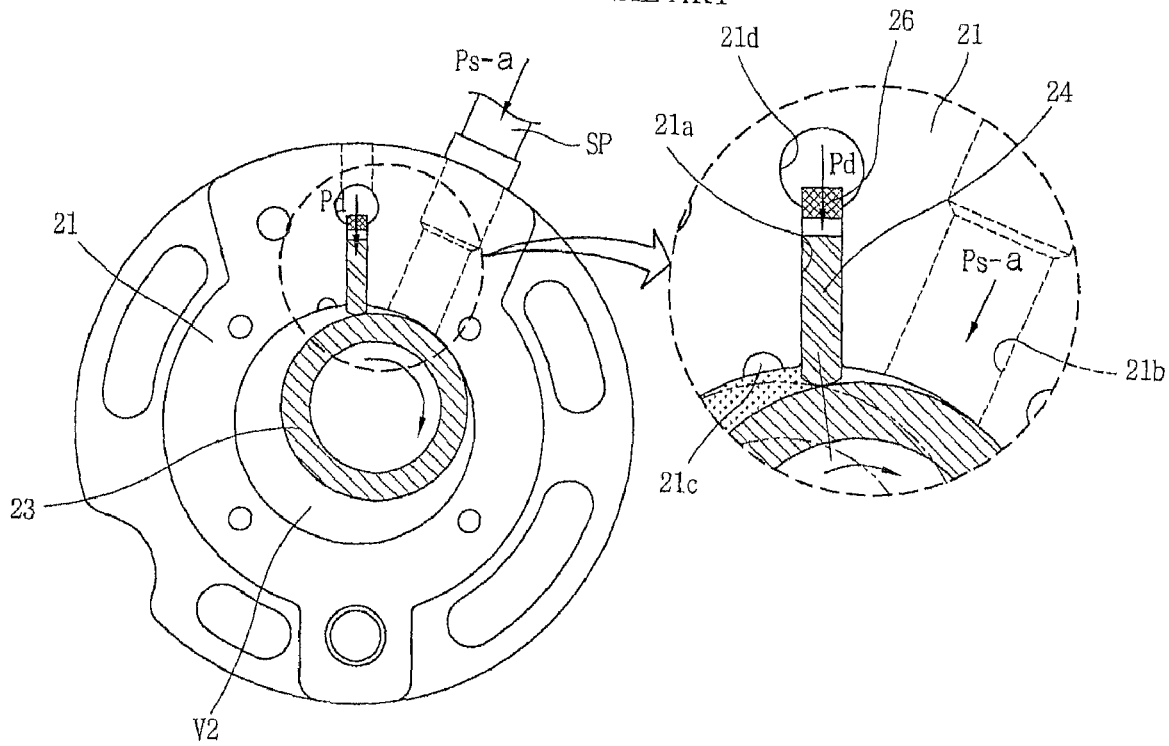
FIG. 6 CONVENTIONAL ART

The second compression unit 120 includes: a second cylinder 121 having an annular shape and installed under the first cylinder 111 inside the casing 1; a middle bearing 113 and a sub-bearing 122 covering both upper and lower sides of the second cylinder 21, forming a second inner space (V2), and supporting the rotating shaft 3 in a radial direction and in an axial direction; a second rolling piston 123 rotatably coupled with a lower eccentric part of the rotating shaft 3 and compressing the refrigerant, orbiting in the second inner space (V2) of the second cylinder 121; a second vane (illustrated in FIG. 3) 124 movably coupled with the second cylinder 121 in the radial direction so as to pressingly contact to an outer circumferential surface of the second rolling piston 123 and dividing the second inner space (V2) of the second cylinder 121 into a second intake chamber and a second compression chamber; a second vane spring 125 which is a compression spring so as to elastically support the rear side of the second vane 124; and a second discharge valve 25 (illustrated in FIG. 1) openably coupled with a front end of a second discharge port 22*a* formed in the vicinity of the center of the sub-bearing 122 and controlling the discharge of the refrigerant gas being discharged from the second chamber.

The second cylinder 121 forms a second vane slit 121*a* at one side of an inner circumferential surface forming the second inner space (V2) such that the second vane 124 reciprocates in the radial direction, forms a second intake 121*b* at one side of a circumferential direction on the basis of the second vane slit 121*a* in the radial direction so as to induce the refrigerant into the second inner space (V2), and forms a second discharge groove 121*c* at the other side of circumferential direction on the basis of the second vane slit 121*a* in the radial direction so as to discharge the refrigerant into the casing 1.

The second vane slit 121*a* slidingly inserts and installs the second vane 124 thereinto in the radial direction, and forms a second expansion grove 121*d* so as to be separated from the inner space of the casing 1. In addition, the second vane spring 125 comprising a compression spring so as to elastically support the second vane 124 is installed at the second expansion groove 121*d*, and a vane-side outlet 143 of the refrigerant switching valve 140 to be described later is connected with its inlet end, that is, with the second expansion groove 121*d* via a second refrigerant guide pipe 152.

In addition, preferably, a second stopper (not illustrated) for limiting a retraction distance of the second vane 124 is provided to prevent the second vane spring 125 from being compressed to make its turn portions come in contact with each other.

The second intake 121*b* is radially formed to penetrate the second cylinder 121 from an outer circumferential surface to an inner circumferential surface, and its inlet end is connected to a cylinder-side outlet 142 of the refrigerant switching valve 140 to be described later via a first refrigerant guide pipe 151.

Though not illustrated in the drawing, the first vane 115 can be supported by permanent magnets (not illustrated) with the same polarity facing each other except for the second vane spring.

Meanwhile, the refrigerant switching valve 140 forms the intake-side inlet 141 and connects the intake-side inlet 141 to the first outlet 131 of the accumulator 130, forms the intake-side inlet 141 and connects the intake-side inlet 141 to the second intake 121*b* of the second cylinder 121, forms the vane-side outlet 143 and connects the vane-side outlet 143 to the second vane slit 121*a* of the second cylinder 121, and forms the discharge-side inlet 144 and connects the discharge-side inlet 144 to a bypass pipe 154 diverging from the middle of the gas discharge pipe (DP).

Portions of the present invention identical to those in the conventional art are given the same reference numerals.

Undescribed reference numerals 2*a*, 2*b* and 160 denote a stator, a rotor, a discharge-side opening or closing valve for connecting or disconnecting the gas discharge pipe with/from the bypass pipe, respectively.

The capacity variable type twin rotary compressor of the present invention has the following operational effect.

That is, if the rotor 2*b* rotates as power is supplied to the stator 2*a* of the motor unit 2, the rotating shaft 3 rotates together with the rotor 2*b* and transfers a rotating force of the motor unit 2 to the first compression unit 110 and the second compression unit 120. The second compression unit 120 performs power driving according to capacity necessary for an air conditioner to generating large-capacity cooling capability or performs saving driving to generate small-capacity cooling capability.

Here, the operation of the capacity variable type twin rotary compressor of the present invention will be described in more detail on the assumption that the first compression unit 110 performs normal power driving, while the second compression unit 120 repeats variable driving according to capacity necessary for an air conditioner.

For example, in the first compression unit 110, it is controlled that refrigerant of balance pressure (Pb) is always supplied to the first intake 111*b* of the first cylinder 111 and that the first vane 115 is always in contact with an outer circumferential surface of the first rolling piston 114 by the first vane spring 116 to separate the compression chamber and the intake chamber of the first inner space (V1) from each other. Thus, compression is normally performed.

Figure 8:
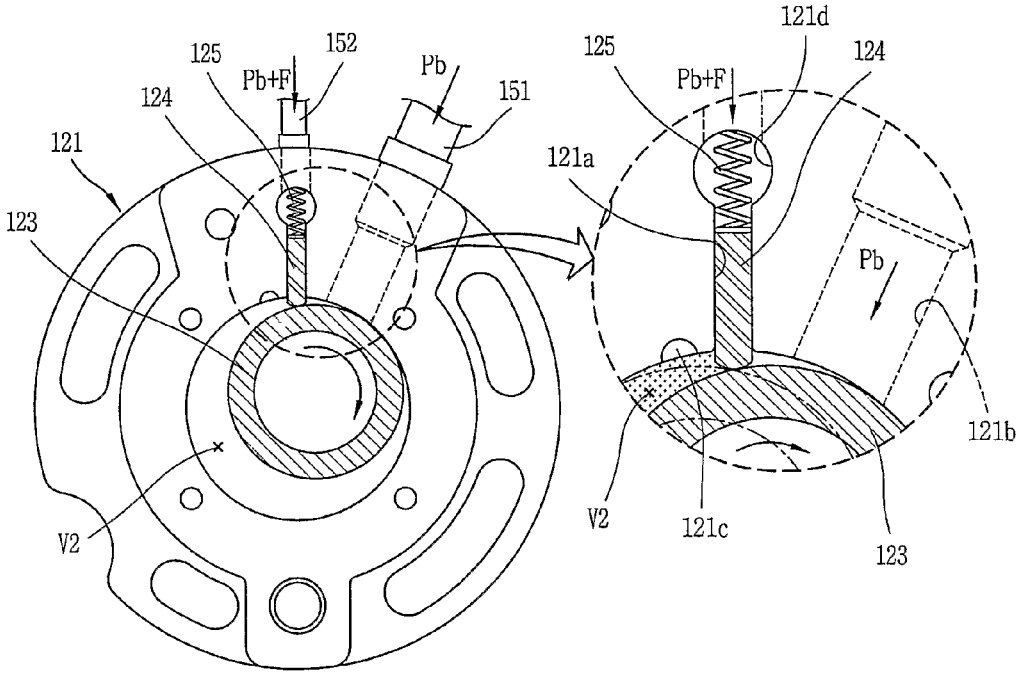
FIGS. 8 to 11 are plane views showing a change of a vane according to each driving state in the capacity variable type twin rotary compressor of the present invention.

At the same time, as illustrated in FIGS. 7 and 8, when the second compression unit 120 is in a starting state, the intake-side inlet 141 of the refrigerant switching valve 140 communicates with the cylinder-side outlet 142 and the accumulator 130 is connected with the second intake 121*b* of the second cylinder 121 via the third refrigerant guide pipe 153, whereby the refrigerant gas of balance pressure (Pb) which will be gradually decreased is drawn into the second inner space (V2) through the second intake 121*b* of the second cylinder 121. On the other hand, as the discharge-side inlet 144 of the refrigerant switching valve 140 communicates with the vane-side outlet 143 and the gas discharge pipe (DP) is connected with the second expansion groove 121*d* through the bypass pipe 154, the refrigerant gas of balance pressure which will be gradually increased is drawn into an outer diameter side of the second vane slit 121*a* of the second cylinder 121, that is, into the second expansion groove 121*d*. However, as pressure inside the casing 1 still maintains the balance pressure, pressure (Pb) flowing into the second expansion groove 121*d* through the gas discharge pipe (DP), the vane-side outlet 143 of the refrigerant switching valve 140 and the second refrigerant guide pipe 152 and therefore pushing the rear end of the second vane 124, and compression chamber pressure (Pb) of the second inner space (V2) maintain an approximate balanced state. Accordingly, the second vane 124 is pushed by a repulsive force (F) of the second vane spring 125 comprising the compression spring or a magnetic substance, moves toward the shaft center and is compressed by an outer circumferential surface of the second rolling piston 123. As a result, normal compression is performed by preventing the so-called vane jumping phenomenon that the second vane 124 and the second rolling piston 123 are continuously detached from each other.

Figure 9:
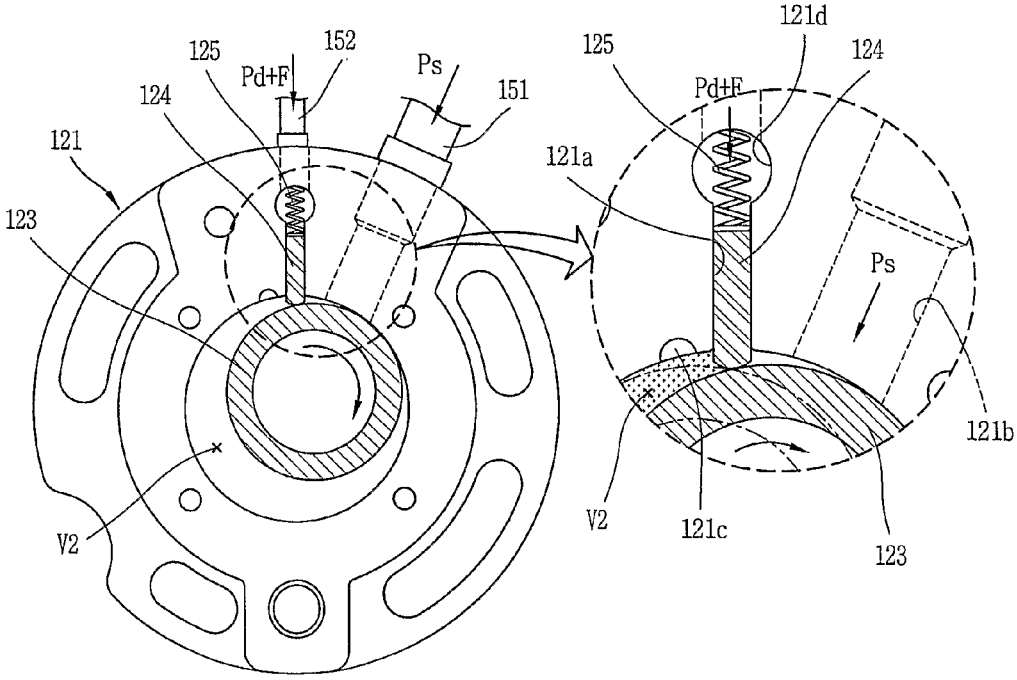

Next , as illustrated in FIGS. 7 and 9, when the second compression unit 120 is in a power state, as the refrigerant switching valve 140 maintains the same state as the starting state as described above, it is controlled that refrigerant of the intake pressure (Ps) is always supplied to the second intake 121*b* of the second cylinder 121, while refrigerant of the discharge pressure (Pd) is always supplied to an outer diameter side of the second vane slit 121*a*, that is, to the second expansion groove 121*d*. Accordingly, the second vane 124 is pushed by differential pressure between the second expansion groove 121*d* of the outer diameter side of the second vane slit 121*a* and the intake chamber and the repulsive force (F) of the second vane spring 125 and therefore maintains a state in which the second vane 124 is compressed by the outer circumferential surface of the second rolling piston 123. As a result, normal compression is continued.

Figure 10:
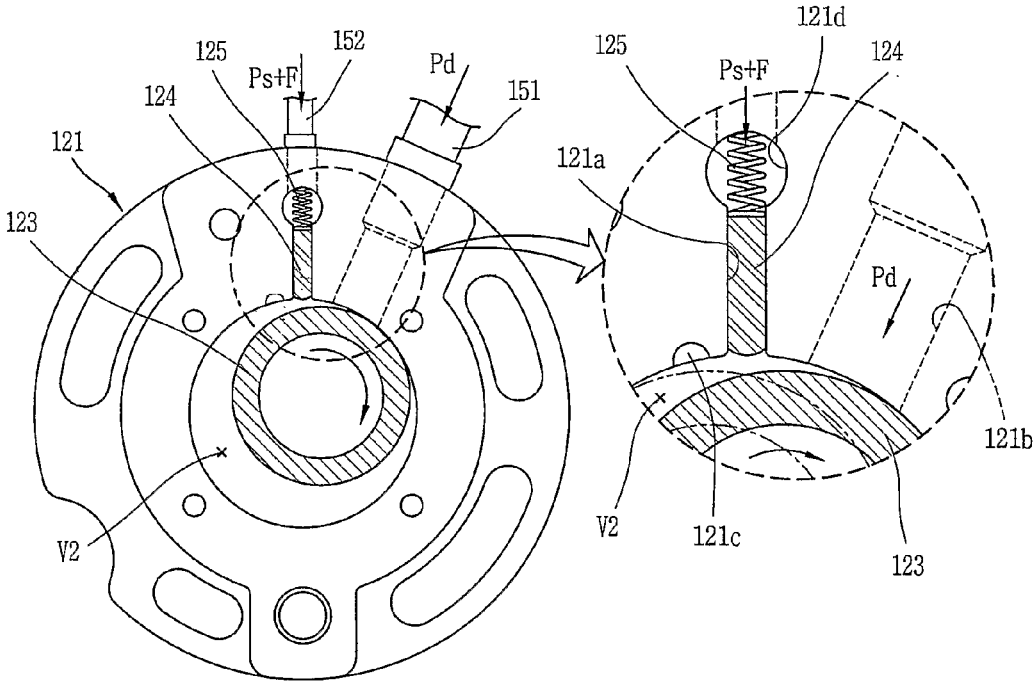

Next, as illustrated in FIGS. 7 and 10, when the second compression unit 120 is in a saving state, as the discharge side inlet 144 and the cylinder side outlet 142 of the refrigerant switching valve 140 communicate with each other and the gas discharge pipe (DP) and the second intake 121*b* of the second cylinder 121 are connected with each other via the bypass pipe 154, refrigerant gas of discharge pressure (Pd) is drawn into the second inner space (V2) through the second intake 121*b* of the second cylinder 121. On the other hand, as the intake-side inlet 141 of the refrigerant switching valve 140 and the vane-side outlet 143 communicate with each other the accumulator 130 and the second expansion groove 121*d* are connected with each other via the third refrigerant guide pipe 153, the refrigerant gas of intake pressure (Ps) is drawn into the second expansion groove 121*d* of the second cylinder 121 through the second refrigerant guide pipe 152. Here, since pressure of the refrigerant gas drawn through the second intake 121*b* of the second cylinder 121 is greater than power obtained by adding pressure of the refrigerant gas drawn into the second expansion groove 121*d* and the repulsive force of the second vane spring 125, the second vane 124 is retracted toward the rear side and separated from the second rolling piston 123, and therefore compression does not occur in the second cylinder 121.

Figure 11:
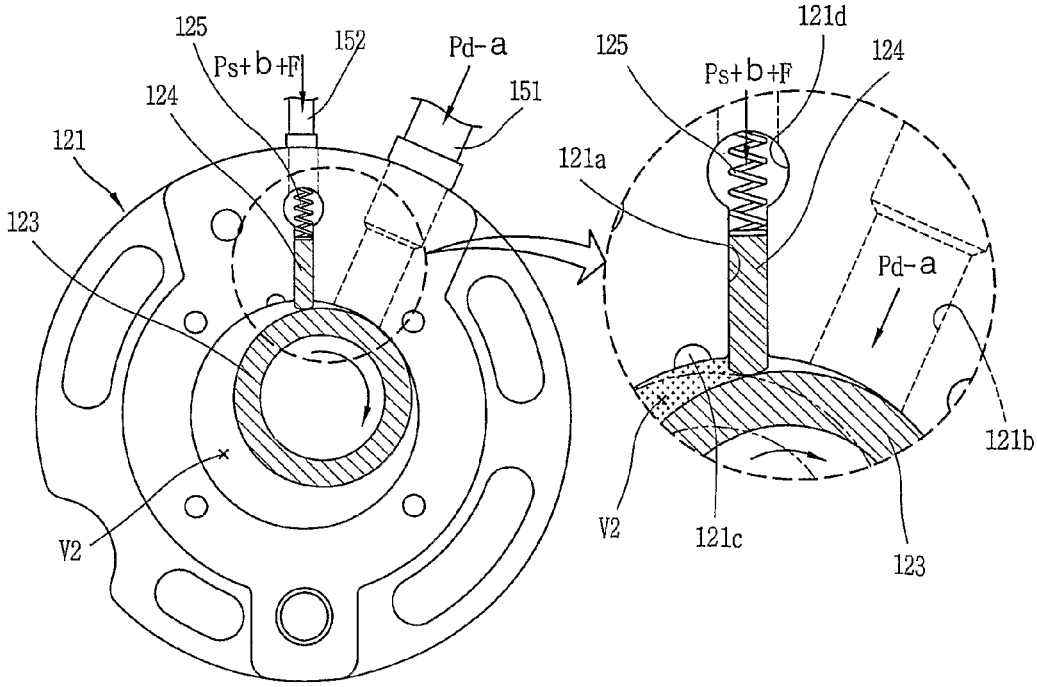

Next, as illustrated in FIGS. 7 and 11, when a driving state of the second compression unit 121 is changed from a saving state to a power state, as the discharge-side inlet 144 of the refrigerant switching valve 140 is switched and communicates with the vane-side outlet 143 from the cylinder-side outlet 142 and the gas discharge pipe (DP) is connected with the second expansion groove 121*d* via the bypass pipe 154, refrigerant gas of middle pressure (Ps+b) which will be gradually in a discharge pressure (Pd) state is drawn into the second expansion groove 121*d* of the second cylinder 121 via the second refrigerant guide pipe 152. On the other hand, as the intake-side inlet 141 of the refrigerant switching valve 140 is switched and communicates with the cylinder-side outlet 142 from the vane-side outlet 143 and the accumulator 130 is connected to the second intake 121*b* of the second cylinder 121 via the third refrigerant guide pipe 153, the refrigerant gas which will be gradually in a second pressure (Pd+a) state is drawn into the second inner space (V2) through the first refrigerant guide pipe 151 and the second intake 121*b* of the second cylinder 121. Here, when the driving is switched, since an unstable state in which the second middle pressure (Pd+a) is higher than the first middle pressure (Ps+b) and then is reversed continues, the vane jumping phenomenon that the second vane 124 is attached to and detached from the outer circumferential surface of the second rolling piston 123 may occur.

However, since the repulsive force (F) of the second vane spring 125 supporting the second vane 124 is greater than differential pressure between the second middle pressure (Pd+a) and the first middle pressure (Ps+b), the second vane 124 is always in contact with the outer circumferential surface of the second rolling piston 123.

Accordingly, noises by the vane jumping can be prevented from occurring.

Meanwhile, another embodiment of the capacity variable type twin rotary compressor of the present invention will be described as follows.

That is, in the aforementioned one embodiment, one compression unit from the first compression unit and the second compression unit comprises a pressure varying unit and a vane-side pressure varying unit so as to increase and decrease compressor capacity by varying a driving state of the compression unit. However, in the present embodiment, both the first compression unit and the second compression unit have cylinder-side pressure varying units and the vane-side pressure varying units, respectively, so as to independently control driving states of both of the compression units, such that the compressor capacity can be increased and decreased by varying according to more than two steps.

Figure 12:
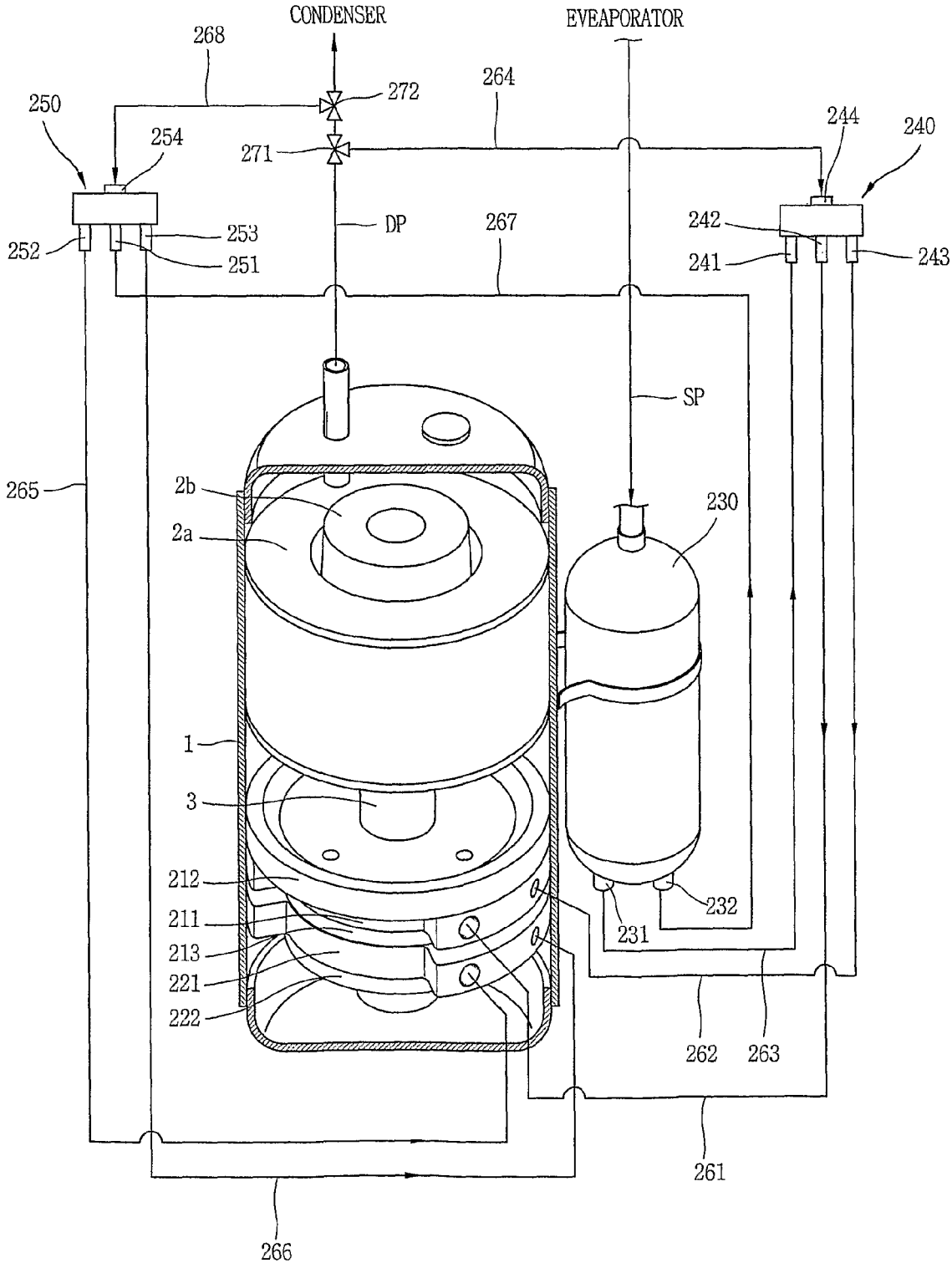
FIG. 12 is a block diagram for varying capacity in another embodiment of the capacity variable type twin rotary compressor of the present invention.

FIG. 12 is a block diagram for varying capacity in another embodiment of the capacity variable type twin rotary compressor of the present invention and FIGS. 13 to 16 are plane views showing a change of a vane according to each driving state in the another embodiment of the capacity variable type twin rotary compressor of the present invention.

As illustrated therein, the capacity variable type twin rotary compressor according to the present invention includes: a casing 1 installing a gas intake pipe (SP) and a gas discharge pipe (DP) such that the gas intake pipe (SP) and the gas discharge pipe (DP) communicate with each other; a motor unit 2 installed at an upper side of the casing 1 and generating a rotating force; and a first compression unit 210 and a second compression unit 220 vertically installed at a lower side of the casing 1, receiving a rotating force being generated from the motor unit 2 by a rotating shaft 3 and individually compressing refrigerant.

In addition, one accumulator 230 for separating liquid refrigerant from intake refrigerant is installed between the gas intake pipe (SP) and each of the compression units 210 and 220. A first refrigerant switching valve 240, which is a four-way valve, switching the refrigerant and supplying the refrigerant to the first compression unit 210 and the second compression unit 220 is installed between an outlet of the accumulator 230 and the gas discharge pipe (DP).

In addition, a first outlet 231 of the accumulator 230 is connected with an intake-side inlet 241 of a first refrigerant switching valve 240 to be described later via a third refrigerant guide pipe 263, and a second outlet 232 of the accumulator 230 is connected to an intake-side inlet 251 of a second refrigerant switching valve 250 to be described later via a seventh refrigerant guide pipe 267.

The first compression unit 210 includes: the first cylinder 211 having an annular shape and installed inside the casing 1; a main bearing 212 and a middle bearing 213 covering both upper and lower sides of the first cylinder 211, forming a first inner space (V1) and radially supporting the rotating shaft 3; a first rolling piston 214 rotatably coupled with an upper eccentric part of the rotating shaft 3 and compressing the refrigerant, orbiting in the first inner space (V1) of the first cylinder 211; a first vane (not illustrated) 215 movably coupled with the first cylinder 211 in a radial direction so as to pressingly contact to an outer circumferential surface of the first rolling piston 214 and dividing the first inner space (V1) of the first cylinder 211 into a first intake chamber and a first compression chamber; a first vane spring 216 which is a compression spring so as to elastically support the rear side of the first vane 215; and a first discharge valve 15 (illustrated in FIG. 1) openably coupled to a front end of a first discharge port 12*a* (illustrated in FIG. 1) formed in the vicinity of the center of the main bearing 212 so as to control the discharge of the refrigerant being discharged from the compression chamber of the first inner space (V1).

The first cylinder 211 forms a first vane slit 211*a* at one side of an inner surface forming the first inner space (V1) such that the first vane 215 reciprocates in the radial direction, forms the first intake 211*b* at one side of the first vane slit 211*a* in a radial direction so as to induce the refrigerant into the first inner space (V1), and forms a first discharge groove 211*c* at the other side of the other side of the first vane slit 211*a* so as to discharge the refrigerant into the casing 1.

The first vane slit 211*a* slidingly inserts and installs the first vane 215 thereinto in the radial direction, and forms a first expansion groove 221*d* at the outer diameter side so as to be separated form the inner space of the casing 1.

In addition, the first vane spring 216 formed of a compression spring so as to elastically support the first vane 215 is installed at the rear side of the first vane slit 211*a*, that is, at the first expansion groove 21*d*, and a vane-side outlet 243 of the first refrigerant switching valve 240 to be described later is connected with its inlet end, that is, with the second expansion groove 221*d* via a second refrigerant guide pipe 252. In addition, the first vane slit 211*a* and a second vane slit 221*a* to be described later can be not formed on the same axis. However, in order to precisely control the compressor, it is preferable that they are formed on the same axis. In addition, preferably, a first stopper (not illustrated) for limiting a retraction distance of the first vane 215 is provided to the first vane slit 211*a* to prevent the second vane spring 225 from being compressed to make its turn portions come in contact with each other.

The first intake 211*b* is radially formed so as to penetrate the first cylinder 211 from its outer circumferential surface to its inner circumferential surface, and its inlet end directly communicates with a cylinder-side outlet 242 of the first refrigerant switching valve 240 via the first refrigerant guide pipe 261.

In addition, the first intake 211*b* and the first discharge groove 211*c* can not be formed on the same axis as respect to a second discharge groove 221*c* to be described later. However, in order to precisely control the compressor, it is preferable that they are formed on the same axis.

Meanwhile, though not illustrated in the drawing, the first vane 215 can be supported by permanent magnets with the same polarity facing each other except for the first vane spring.

The second compression unit 220 includes: a second cylinder 221 having an annular shape and installed under the first cylinder 211 inside the casing 1; a middle bearing 213 and a sub-bearing 222 covering both upper and lower sides of the second cylinder 221, forming a second inner space (V2), and supporting the rotating shaft 3 in a radial direction and in an axial direction; a second rolling piston 223 rotatably coupled with a lower eccentric part of the rotating shaft 3 and compressing the refrigerant, orbiting in the second inner space (V2) of the second cylinder 221; a second vane (illustrated in FIG. 3) 124 movably coupled with the second cylinder 121 in the radial direction so as to pressingly contact to an outer circumferential surface of the second rolling piston 123 and dividing the second inner space (V2) of the second cylinder 121 into a second intake chamber and a second compression chamber; a second vane spring 125 which is a compression spring so as to elastically support the rear side of the second vane 224; and a second discharge valve 25 (illustrated in FIG. 1) openably coupled with a front end of a second discharge port 22*a* formed in the vicinity of the center of the sub-bearing 222 and controlling the discharge of the refrigerant gas being discharged from the second chamber.

The second cylinder 221 forms a second vane slit 221*a* at one side of an inner circumferential surface forming the second inner space (V2) such that the second vane 224 reciprocates in the radial direction, forms a second intake 221*b* at one side of a circumferential direction on the basis of the second vane slit 221*a* in the radial direction so as to induce the refrigerant into the second inner space (V2), and forms a second discharge groove 221*c* at the other side of circumferential direction on the basis of the second vane slit 221*a* in the radial direction so as to discharge the refrigerant into the casing 1.

The second vane slit 221*a* slidingly inserts the second vane 224 thereinto in the radial direction, and forms a second expansion grove 221*d* at the outer diameter side so as to be separated from the casing 1. In addition, the second vane spring 225 comprising a compression spring so as to elastically support the second vane 224 is installed at the rear side of the second vane slit 221*a*, that is, at the second expansion groove 221*d*, and a vane-side outlet 253 of a second refrigerant switching valve 250 to be described later is connected with its inlet end via a fifth refrigerant guide pipe 266.

In addition, preferably, a second stopper (not illustrated) for limiting a retraction distance of the second vane 224 is provided to prevent the second vane spring 225 from being compressed to make its turn portions come in contact with each other.

The second intake 221*b* is radially formed to penetrate the second cylinder 221 from an outer circumferential surface to an inner circumferential surface, and its inlet end is connected to a cylinder-side outlet 252 of the refrigerant switching valve 250 to be described later via a fourth refrigerant guide pipe 265.

Though not illustrated in the drawing, the second vane 224 can be supported by permanent magnets (not illustrated) with the same polarity facing each other except for the first vane spring.

Meanwhile, the first refrigerant switching valve 240 forms the intake-side inlet 241 and connects the intake-side inlet 241 to the first outlet 231 of the accumulator 230, forms the first cylinder-side outlet 242 and connects the first cylinder-side outlet 242 to the first intake 211*b* of the first cylinder 211, forms the first vane-side outlet 243 and connects the first vane-side outlet 243 to a first expansion groove 211*d* of the first cylinder 211, and forms the first discharge-side inlet 244 and connects the first discharge-side inlet 244 to a first bypass pipe 264 diverging from the middle of the gas discharge pipe (DP).

In addition, the second refrigerant switching valve 250 forms the intake-side inlet 251 and connects the intake-side inlet 251 to the second outlet 232 of the accumulator 230, forms the second cylinder-side outlet 252 and connects the second cylinder-side outlet 252 to the second intake 221*b* of the second cylinder 221, forms the second vane-side outlet 253 and connects the second vane-side outlet 253 to the second expansion groove 221*d* of the second cylinder 221, and forms the second discharge-side inlet 254 and connects the second discharge-side inlet 254 to a second bypass pipe 268 diverging from the middle of the gas discharge pipe (DP).

Portions of the present invention identical to those in the conventional art are given the same reference numerals.

Undescribed reference numerals 2*a*, 2*b*, 271 and 272 denote a stator, a rotor, a discharge-side opening or closing valve for connecting or disconnecting the gas discharge pipe with/from a first bypass pipe and for connecting or disconnecting the gas discharge pipe with/froom a second bypass pipe, respectively.

The capacity variable type twin rotary compressor of the present invention has the following operational effect.

That is, if the rotor 2*b* rotates as power is supplied to the stator 2*a* of the motor unit 2, the rotating shaft 3 rotates together with the rotor 2*b* and transfers a rotating force of the motor unit 2 to the first compression unit 210 and the second compression unit 220. Both the first compression unit 210 and the second compression unit 220 perform power driving according to capacity necessary for an air conditioner. Otherwise, one from the first compression unit 210 the second compression unit 220 performs power driving and the other compression unit performs saving driving to thereby generate phased small-capacity cooling capability.

Here, the operation of the capacity variable type twin rotary compressor of the present invention will be described in more detail on the assumption that the first compression unit 210 performs normal power driving, while the second compression unit 220 repeats variable driving according to capacity necessary for an air conditioner.

In FIGS. 13 to 16, the second compression unit performs variable driving even though either the first compression unit or the second compression unit can performs variable driving.

That is, in the first compression 210, as the first discharge-side inlet 244 of the first refrigerant switching valve 240 communicates with the first cylinder-side outlet 242 and the first intake-side inlet 241 communicates with the first vane-side outlet 243, it is controlled that refrigerant of discharge pressure (Pd) is always supplied to the first intake 211*b* of the first cylinder 211 and refrigerant of intake pressure (Ps) is always supplied to the first expansion groove 211*d* of the first cylinder 211 such that the first vane 215 is always in contact with the outer circumferential surface of the first rolling piston 214 to separate the compression chamber and the intake chamber of the first inner space (V1) from each other.

Figure 13:
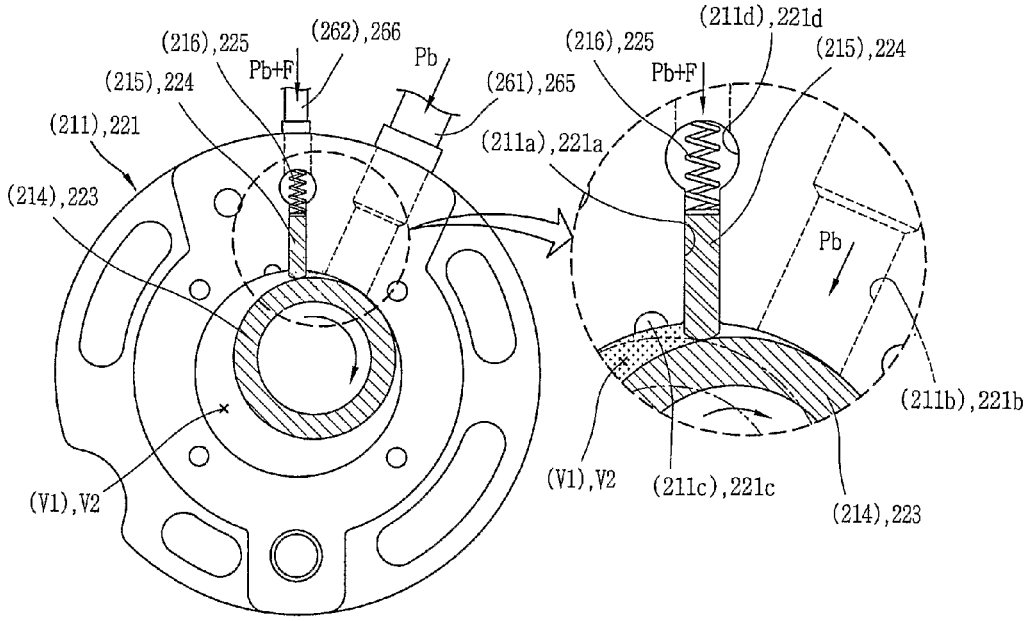
FIGS. 13 to 16 are plane views showing a change of a vane according to each driving state in the another embodiment of the capacity variable type twin rotary compressor of the present invention.

At the same time, as illustrated in FIGS. 12 and 13, when the second compression unit 220 is in a starting state, the intake-side inlet 251 of the refrigerant switching valve 250 communicates with the cylinder-side outlet 252 and the intake 251 of the second refrigerant switching valve 250 of the second cylinder 221 is connected with the accumulator 230 via a sixth refrigerant guide pipe 267, whereby the refrigerant gas of balance pressure (Pb) which will be gradually decreased is drawn into the second inner space (V2) through the second intake 221*b* of the second cylinder 221. On the other hand, as the discharge-side inlet 254 of the refrigerant switching valve 250 communicates with the vane-side outlet 253 and the gas discharge pipe (DP) is connected with the second expansion groove 221*d* through the second bypass pipe 268, the refrigerant gas of balance pressure which will be gradually increased is drawn into the second expansion groove 221*d* of the second cylinder 221. Here, as internal pressure of the casing 1 gradually increases, refrigerant of higher pressure is supplied to the second expansion groove 221*d* connected with this.

Accordingly, the second vane 224 is pushed toward the shaft center by pressure applied at is rear surface and a repulsive force (F) of the second vane spring 225 comprising the compression spring or a magnetic substance, and is compressed by an outer circumferential surface of the second rolling piston 223. As a result, normal compression is performed by preventing the so-called vane jumping phenomenon that the second vane 224 and the second rolling piston 223 are continuously detached from each other.

Figure 14:
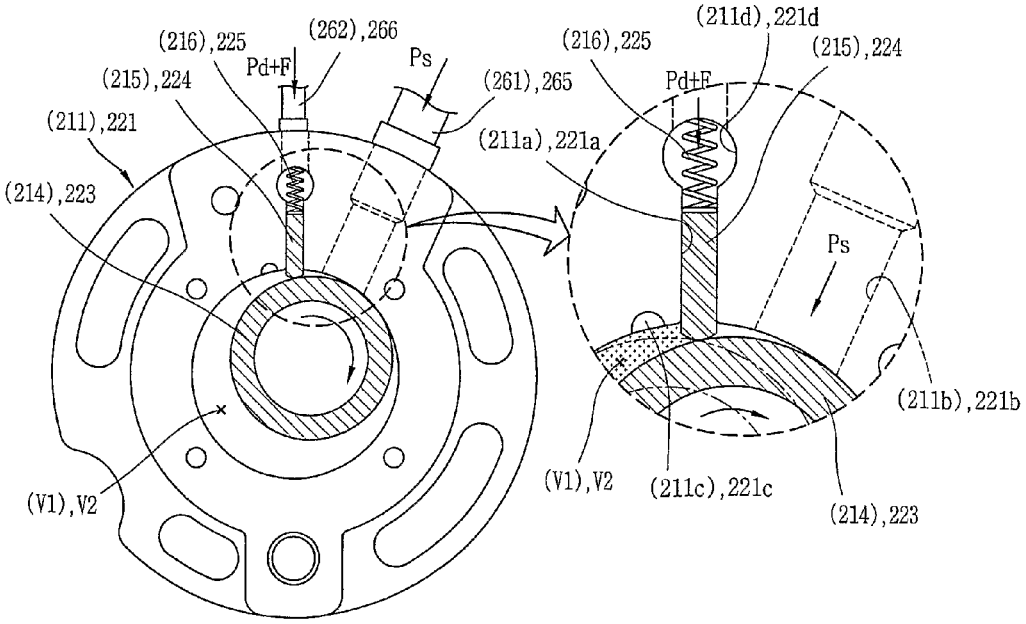

Next, as illustrated in FIGS. 12 and 14, in order that the second compression unit 220 is in a power state, as the refrigerant switching valve 250 maintains the same state as the starting state as described above, it is controlled that refrigerant of the intake pressure (Ps) is always supplied to the second intake 221*b* of the second cylinder 221, while refrigerant of the discharge pressure (Pd) is always supplied to the second expansion groove 221*d*. Accordingly, the second vane 224 is pushed by differential pressure between the second expansion groove 221*d* and the intake chamber and the repulsive force (F) of the second vane spring 225 comprising the compression spring or the magnetic body and maintains a state in which the second vane 224 is compressed by the outer circumferential surface of the second rolling piston 223. As a result, normal compression is continued.

Figure 15:
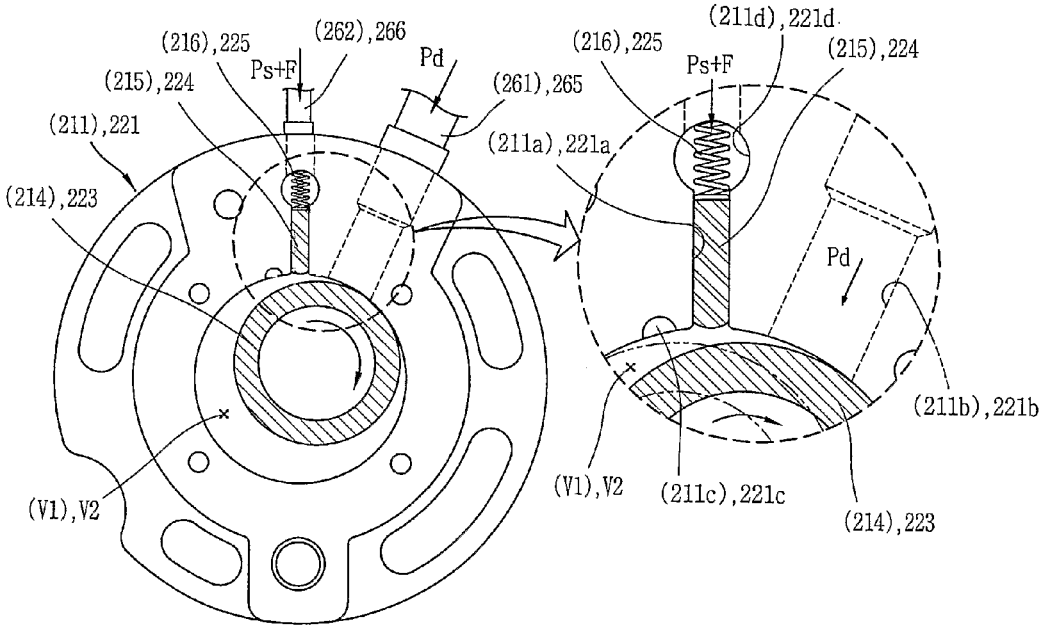

Next, as illustrated in FIGS. 12 and 15, as the second compression unit 220 is in a saving state, as the discharge side inlet 254 and the cylinder side outlet 252 of the second refrigerant switching valve 250 communicate with each other, the refrigerant gas of the discharge pressure (Pd) passes the gas discharge pipe (DP), the second bypass pipe 268, the cylinder-side outlet 252 of the second refrigerant switching valve 250 and the fourth refrigerant guide pipe 265 and is guided to the second intake 221*b* of the second cylinder 221, and the refrigerant is drawn into the second inner space (V2) through the intake 221*b* of the second cylinder 221. On the other hand, as the intake-side inlet 251 of the refrigerant switching valve 250 and the vane-side outlet 253 communicate with each other and the accumulator 230 and the second expansion groove 221*d* of the second cylinder 221 are connected with each other via the sixth refrigerant guide pipe 267, the refrigerant gas of intake pressure (Ps) is drawn into the rear side of the second vane 224, that is, into the second expansion groove 221*d* of the second cylinder 221. Here, since pressure of the refrigerant gas drawn through the second intake 221*b* of the second cylinder 221 is greater than power obtained by adding pressure of the refrigerant gas drawn into the second expansion groove 221*d* and the repulsive force (F) of the second vane spring 225, the second vane 224 is retracted toward the rear side and separated from the second rolling piston 223, and therefore compression does not occur in the second cylinder 221.

Figure 16:
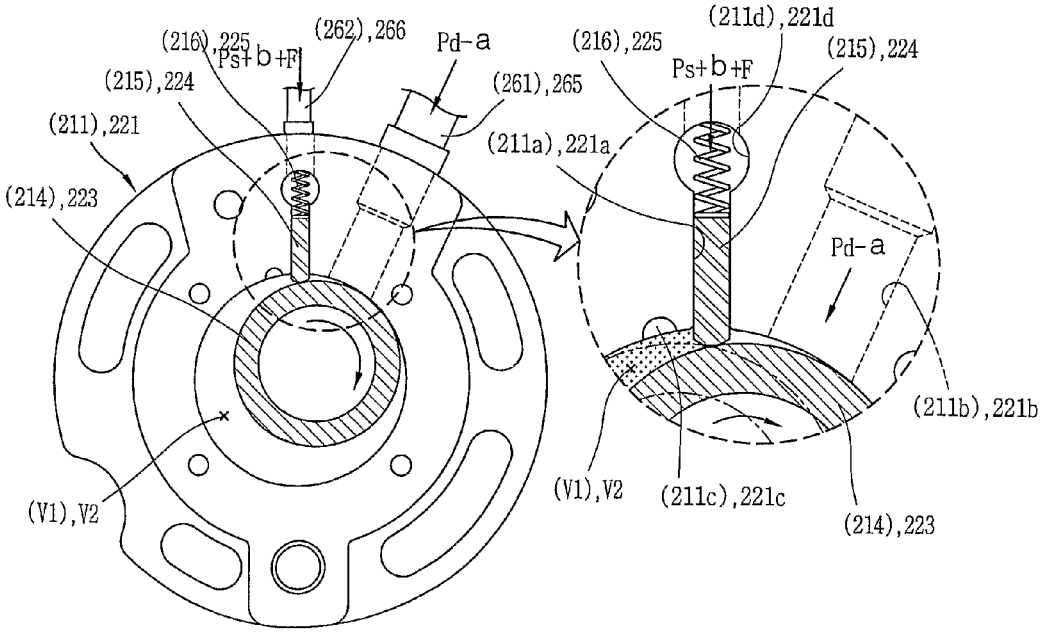

Next, as illustrated in FIGS. 12 and 16, when a driving state of the second compression unit 220 is changed from a saving state to a power state, as the discharge-side inlet 254 of the second refrigerant switching valve 250 is switched and communicates with the vane-side outlet 253 from the cylinder-side outlet 252 and the gas discharge pipe (DP) is connected with the second expansion groove 221*d* via the second bypass-pipe 268, refrigerant gas of first middle pressure (Ps+b) which will be gradually in a discharge pressure (Pd) state is drawn into the second expansion groove 221*d* of the second cylinder 221. On the other hand, as the intake-side inlet 251 of the second refrigerant switching valve 250 is switched and communicates with the cylinder-side outlet 252 from the vane-side outlet 253 and the accumulator 230 is connected to the second intake 221*b* of the second cylinder 221 via the sixth refrigerant guide pipe 267, the refrigerant gas which will be gradually in a second pressure (Pd+a) state is drawn into the second inner space (V2) through the second intake 221*b* of the second cylinder 221. Here, when its driving is changed, since an unstable state in which the second middle pressure (Pd+a) is higher than the first middle pressure (Ps+b) and then is reversed continues for a certain pressure section, the vane jumping phenomenon that the second vane 224 is attached to and detached from the outer circumferential surface of the second rolling piston 223 may occur. However, since the repulsive force (F) of the second vane spring 225 supporting the second vane 224 is greater than differential pressure between the second middle pressure (Pd+a) and the first middle pressure (Ps+b), the second vane 224 is always in contact with the outer circumferential surface of the second rolling piston 223. Accordingly, noises by the vane jumping can be prevented from occurring.

Meanwhile, as described above, as occasion demands, the second compression unit 220 performs normal power driving, while the first compression unit 210 performs variable driving, whereby capacity of the compressor can be varied. In this case, in a state that the second refrigerant switching valve 250 is manipulated identically with the first refrigerant switching valve 240 in the aforementioned one embodiment, the first refrigerant switching valve 240 is manipulated identically with the second refrigerant switching valve 250 of the above-described one embodiment to thusly perform starting, power, saving and driving-switched states.

Through this, the capacity of the compressor can be controlled by being divided into three steps. For example, when the first compression unit 210 is set to 60% and the second compression unit is set to 40% of the entire capacity, both compression units 210 and 220 perform normal driving to thereby obtain 100% cooling capability, the entire capacity of the compressor. On the other hand, if the first compression unit 210 performs driving in a normal state and the second compression unit in a saving state, 40% cooling capability can be obtained. If the first compression unit 210 performs driving in a saving state and the second compression unit 220 in a normal state, 60% cooling capability can be obtained.

A description will be made when such a compressor applied to an air conditioner is operated.

Figure 17:
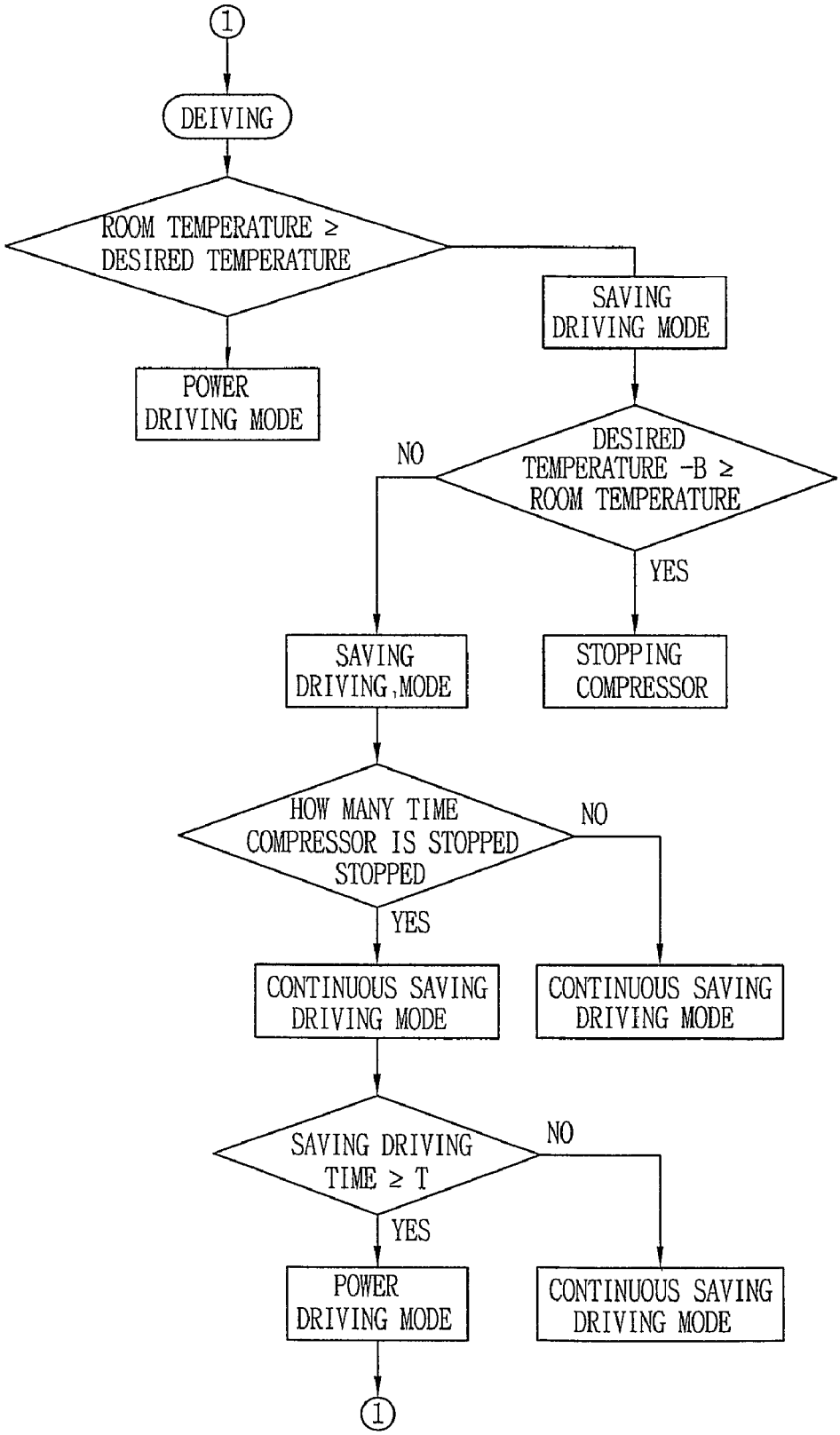
FIG. 17 is a flow chart showing a driving method of an air conditioner having the capacity variable type twin rotary compressor of the present invention.

That is, as illustrated in FIG. 17, room temperature is detected using a temperature sensor mounted on an indoor heat exchanger of the air conditioner. If the room temperature reaches [desired temperature+0.5°], a relay (not illustrated) of MICOM is turned off and the compressor is changed into a power driving mode.

Next, if the room temperature increases again and exists in [desired temperature+0.5°] for two minutes consecutively, the compressor is changed into the power driving mode again. On the other hand, if the room temperature decreases and reaches [desired temperature −1.0°], the compressor is stopped.

Here, after the compressor is changed into a saving driving mode and saving driving is performed, if compressor is stopped twice consecutively due to a decrease in the room temperature, the compressor is changed into a consecutive saving driving mode. If a time for the saving driving mode of the compressor exceeds a particular period of time, the compressor is immediately changed into the power driving mode and then is returned to the early stage, preferably.

Figure 18:
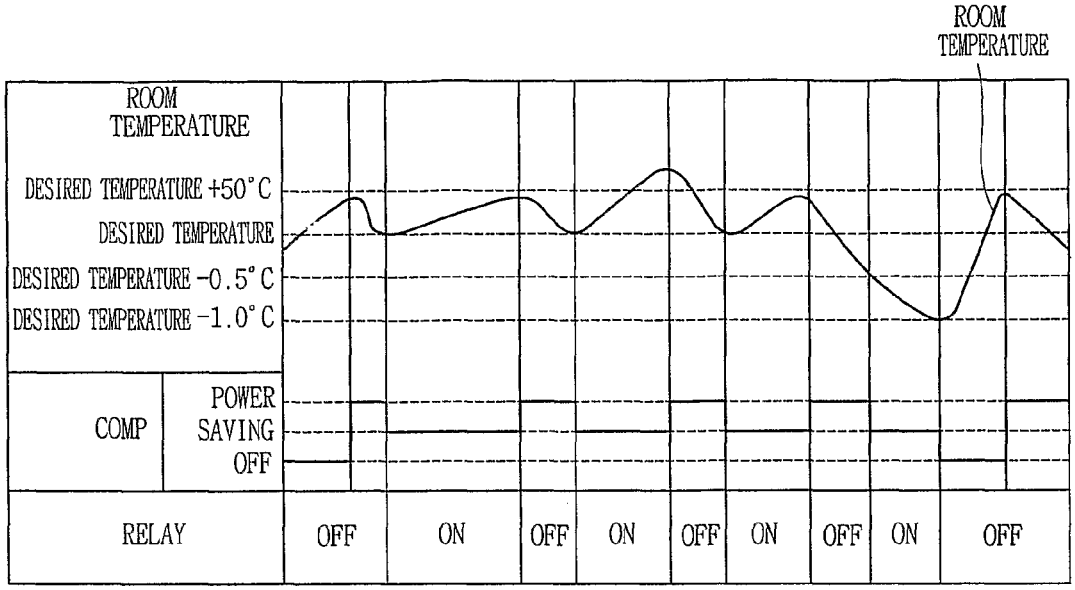
FIG. 18 is a development FIG. ure showing one example of the aforementioned air conditioner driving method according to time.

For reference, FIG. 18 is a development diagram showing one example of the aforementioned air conditioner driving method according to time.

As described so far, in the capacity variable type twin rotary compressor, in a starting state and a driving-switched state in which the driving of a vane can be unstable, it is constructed that the vane can quickly and stably come in contact with a rolling piston, such that noises resulted from the vane when varying capacity are prevented from occurring to thereby significantly reduce compressor noises and the compressor can start without noises resulted form vane jumping even in a power mode to thereby quickly set room temperature to pleasant temperature when applied to an air conditioner.

In addition, as it is constructed that both the first compression unit and the second unit can be controlled, compressor capacity can be varied according to more than two steps when capacity of each compression unit differs, whereby it is possible to meet various demands for assembly products such as the air conditioner and to reduce power consumption by reducing unnecessary waste of power.

The present invention can greatly reduce noises of a compressor by preventing noises, meet various demands of assembly products such as air conditioners by allowing capacity of the compressor to vary according to more than two steps variable and increase energy efficiency by reducing unnecessary power consumption.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A capacity variable type twin rotary compressor, comprising:

a casing having an inner space formed therein;

a gas discharge pipe that communicates with the inner space;

a motor fixed in the inner space and configured to generate a rotational force;

a first cylinder fixed to one side of the motor and having a first compression space formed therein for compressing refrigerant, the first cylinder including a first intake connected to a gas intake pipe so as to guide refrigerant into the first compression space, and a first vane slit formed at one side of the first intake;

a first rolling piston eccentrically coupled to the motor and received in the first compression space;

a first vane slidably received in the first vane slit in a radial direction;

a second cylinder having a second compression space formed therein that is separated from the first compression space of the first cylinder, the second cylinder being fixed to one side of the first cylinder, the second cylinder including second connected to the gas intake pipe so as to guide refrigerant into the second compression space, a second vane slit formed at one side of the second intake, and an expansion groove formed at an outer circumferential portion of the second vane slit so as to be separated from the inner space of the casing;

second rolling piston eccentrically coupled to the motor and received in the second compression space;

a second vane slidably received in the second vane slit; and refrigerant switching valves configured to allow refrigerant at an intake pressure and refrigerant at a discharge pressure to be alternately supplied into the second compression space of the second cylinder and the expansion groove of the second vane slit, such that the second vane contacts the second rolling piston to perform a power driving operation, and is separated from the second rolling piston to perform a saving driving operation, wherein each of the vane switching valves comprises:

a cylinder-side outlet connected to the second intake of the second cylinder via a first refrigerant guide pipe;

a vane-side outlet connected to the expansion groove of the second vane slit via a second refrigerant guide pipe;

an intake-side inlet connected to the gas intake pipe via a third refrigerant guide pipe; and a discharge-side inlet connected to the gas discharge pipe via a bypass pipe, wherein the refrigerant switching valves are configured to simultaneously allow the discharge side inlet to communicate with the vane-side outlet and the intake-side inlet to communicate with the cylinder-side outlet, or to simultaneously allow the discharge-side inlet to communicate with the vane-side outlet and the intake-side inlet to communicate with the vane-side outlet, so as to control refrigerant flow direction during the saving driving operation.

2. The compressor of claim 1, wherein a tangent line of the first vane and the first rolling piston is formed on the same axis as a tangent line of the second vane and the second rolling piston.

3. The compressor of claim 1, further comprising a compression spring positioned between a rear surface of the second vane and the second vane slit so as to support the second vane in a radial direction of the second cylinder by an elastic force generated by the compression spring.

4. The compressor of claim 1, further comprising magnetic bodies installed at a rear surface of the second vane and a surface of the second vane slit facing the rear surface of the second vane so as to support the second vane in a radial direction of second cylinder using a magnetic force generated by the magnetic bodies, the magnetic bodies having the same polarity and positioned facing each other.

5. An air conditioner having the capacity variable type twin rotary compressor of claim 1.

* * * * *